US011075444B2

(12) United States Patent
Jeon et al.

(10) Patent No.: US 11,075,444 B2
(45) Date of Patent: Jul. 27, 2021

(54) ANTENNA AND ELECTRONIC DEVICE COMPRISING THE ANTENNA

(71) Applicant: Samsung Electronics Co., Ltd., Suwon-si (KR)

(72) Inventors: Seung Gil Jeon, Suwon-si (KR); Jeong Heum Lee, Suwon-si (KR); Jae Bong Chun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 142 days.

(21) Appl. No.: 16/199,876

(22) Filed: Nov. 26, 2018

(65) Prior Publication Data

US 2019/0165452 A1 May 30, 2019

(30) Foreign Application Priority Data

Nov. 28, 2017 (KR) ..... 10-2017-0160539

(51) Int. Cl.
*H01Q 1/24* (2006.01)
*H01Q 1/44* (2006.01)
(Continued)

(52) U.S. Cl.
CPC ..... *H01Q 1/243* (2013.01); *H01Q 1/44* (2013.01); *H01Q 1/526* (2013.01);
(Continued)

(58) Field of Classification Search
CPC ..... H01Q 1/243; H01Q 19/10; H01Q 17/001; H01Q 21/29; H01Q 1/526; H01Q 1/44; H01Q 9/0421; H01Q 19/108
See application file for complete search history.

(56) References Cited

U.S. PATENT DOCUMENTS 5,539,414 A 7/1996 Keen
5,821,902 A 10/1998 Keen
(Continued)

FOREIGN PATENT DOCUMENTS

CN 1132572 A 10/1996
CN 103812540 A 5/2014
(Continued)

OTHER PUBLICATIONS

International Search Report dated Feb. 28, 2019; International Application # PCT/KR2018/014629.
(Continued)

*Primary Examiner* — Dimary S Lopez Cruz
*Assistant Examiner* — Michael M Bouizza
(74) *Attorney, Agent, or Firm* — Jefferson IP Law, LLP

(57) ABSTRACT

An electronic device is provided. The electronic device includes a housing that includes a front surface, a rear surface facing away from the front surface, and a side surface surrounding a space between the front surface and the rear surface, wherein the front surface includes a dielectric substance having a first permittivity and the rear surface includes a dielectric substance having a second permittivity, an antenna array that is positioned adjacent to the side surface, radiates a millimeter wave signal, the antenna array including at least one antenna element, a communication circuit that is electrically connected with the antenna array and communicates by using the millimeter wave signal, and an electrical element that is positioned to be spaced from the antenna array by a specified distance such that a radiation pattern of the millimeter wave signal radiated from the antenna array has a directivity toward the side surface.

20 Claims, 19 Drawing Sheets

(51) Int. Cl.

| | |
|---|---|
| ***H01Q 9/04*** | (2006.01) |
| ***H01Q 19/10*** | (2006.01) |
| ***H01Q 17/00*** | (2006.01) |
| ***H01Q 21/29*** | (2006.01) |
| ***H01Q 1/52*** | (2006.01) |

(52) U.S. Cl.
CPC ..... *H01Q 9/0421* (2013.01); *H01Q 17/001* (2013.01); *H01Q 19/10* (2013.01); *H01Q 21/29* (2013.01); *H01Q 19/108* (2013.01)

(56) References Cited

U.S. PATENT DOCUMENTS

| | | | |
|---|---|---|---|
| 6,975,276 | B2 | 12/2005 | Brown |
| 7,864,120 | B2 | 1/2011 | Dou et al. |
| 8,311,661 | B2 | 11/2012 | Krapf et al. |
| 9,048,542 | B2 | 6/2015 | Han et al. |
| 9,160,065 | B2 | 10/2015 | Lu et al. |
| 9,281,878 | B2 | 3/2016 | Wu et al. |
| 9,666,952 | B2 | 5/2017 | Fujita et al. |
| 9,667,290 | B2 | 5/2017 | Ouyang et al. |
| 10,084,490 | B2 | 9/2018 | Ouyang et al. |
| 10,153,539 | B2 | 12/2018 | Seo et al. |
| 10,227,808 | B2 | 3/2019 | Siddiqui |
| 10,305,172 | B2 | 5/2019 | Noori et al. |
| 2004/0174314 | A1 | 9/2004 | Brown |
| 2008/0297419 | A1 | 12/2008 | Dou et al. |
| 2010/0106284 | A1 | 4/2010 | Krapf et al. |
| 2013/0207869 | A1 | 8/2013 | Han et al. |
| 2014/0028515 | A1 | 1/2014 | Lu et al. |
| 2014/0050283 | A1 | 2/2014 | Leiba |
| 2015/0325922 | A1 | 11/2015 | Fujita et al. |
| 2016/0254590 | A1 | 9/2016 | Seo et al. |
| 2016/0308563 | A1 | 10/2016 | Ouyang et al. |
| 2017/0201014 | A1* | 7/2017 | Lee ..... H01Q 1/44 |
| 2017/0214120 | A1* | 7/2017 | Lee ..... H01Q 21/293 |
| 2017/0302306 | A1 | 10/2017 | Ouyang et al. |
| 2017/0309991 | A1 | 10/2017 | Noori et al. |
| 2017/0309992 | A1 | 10/2017 | Noori et al. |
| 2018/0026341 | A1 | 1/2018 | Mow et al. |
| 2019/0020365 | A1 | 1/2019 | Ouyang et al. |

FOREIGN PATENT DOCUMENTS

| | | | |
|---|---|---|---|
| CN | 105811074 | A | 7/2016 |
| CN | 106850122 | A | 6/2017 |
| JP | 2002-290297 | A | 4/2002 |
| JP | 3212835 | A | 1/2018 |

OTHER PUBLICATIONS

European Search Report dated Apr. 11, 2019; Reference #: 3B/2YE08/297; Application#/Patent #: 18208614.0-1205.
Ohinese Office Action dated Jun. 3, 2021, issued in Chinese Patent Application No. 201880077028.1 X.

* cited by examiner

ANTENNA AND ELECTRONIC DEVICE COMPRISING THE ANTENNA

CROSS-REFERENCE TO RELATED APPLICATION(S)

This application is based on and claims priority under 35 U.S.C. § 119 of a Korean patent application number 10-2017-0160539, filed on Nov. 28, 2017, in the Korean Intellectual Property Office, the disclosure of which is incorporated by reference herein its entirety.

BACKGROUND

1. Field

The disclosure relates to an antenna and an electronic device including an antenna.

2. Description of Related Art

As the information technology (IT) develops, electronic devices are being widely supplied. An electronic device may communicate with any other electronic device or a base station by using an antenna.

Nowadays, as the network traffic of a mobile device sharply increases, the next-generation mobile communication technology using a signal in an ultra-high-frequency band, for example, the $5^{th}$ generation (5G) technology is being developed. If the signal in the ultra-high-frequency band is used, a wavelength of the signal may become short to a millimeter unit. Also, since a wider bandwidth may be used, a significant amount of information may be transmitted or received. Since an antenna array has an effective isotropically radiated power (EIRP) greater than one antenna, the antenna array may transmit/receive various kinds of data more effectively. The signal in the ultra-high-frequency band may be referred to as a "so-called millimeter wave signal".

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the problems and/or disadvantages of existing technology and to provide at least the advantages described below. In the mobile communication technology before 5G, a frequency of an electromagnetic wave may be relatively low, and a wavelength may be relatively long. For example, in the case of a Wi-Fi signal, a frequency may be approximately 2.4 GHz, and a wavelength is approximately 125 mm. Since a thickness of a housing, for example, a dielectric substance is very small compared with the wavelength, distortion of a radiation pattern due to the housing may be ignorable with regard to communication performance of an electronic device.

In the case where an electromagnetic wave passes through a dielectric substance having permittivity of a specified magnitude, a wavelength of the electromagnetic wave may be changed. In this case, if the dielectric substance is present only in a partial region, a travel speed of the electromagnetic wave passing through the dielectric substance may be different from the electromagnetic wave not passing through the dielectric substance, thereby causing distortion of a radiation pattern of a radiated electromagnetic wave. For example, if the dielectric substance forms a specified angle with respect to a propagation direction of an electromagnetic wave, influences of a horizontal component and a vertical component of the electromagnetic wave due to the dielectric substance may be different from each other in magnitude, thereby causing more serious distortion of the radiation pattern.

At least a portion of the housing of the electronic device may include a dielectric substance having permittivity of a specified magnitude. In this case, a radiation pattern which is formed by an electromagnetic wave radiated from an antenna positioned within the housing may be distorted while the electromagnetic wave passes through the housing.

In the 5G mobile communication technology, an electromagnetic wave (e.g., a millimeter wave signal) including a frequency of the ultra-high-frequency band, for example, 28 GHz may be used for wireless communication. A wavelength of the electromagnetic wave including the frequency of 28 GHz is approximately 10.7 mm. Since the wavelength of the electromagnetic wave of the ultra-high-frequency band is very short, a relative thickness of the housing of the electronic device may become large. That is, as the 5G mobile communication technology approaches, the distortion of the radiation pattern due to the housing may have a meaningful influence of the communication performance of the electronic device.

In the case where a component of an electromagnetic wave arrives at a dielectric substance, a relative thickness of which is larger than a specified thickness, the effect that the dielectric substance operates as a second antenna may appear. For example, if an electromagnetic wave arrives at the dielectric substance after being radiated from an antenna (e.g., first radiation), second radiation coming from the electromagnetic wave may be made at the dielectric substance. In this case, the first radiation and the second radiation may have a radiation characteristic which is similar to a radiation characteristic of a radiation pattern formed by antenna elements constituting an array antenna. For example, directivity may be given in a specific direction, and a null region may appear.

In the case of an array of antennas which are arranged with a given rule, a design may be possible to have directivity in a target direction. However, in the case where a dielectric substance is included in an electronic device, a radiation pattern of the antenna array may be distorted, and the directivity may not be given in a target direction of a radiation pattern of a millimeter wave signal.

Aspects of the present disclosure are to address at least the above-mentioned problems and/or disadvantages and to provide at least the advantages described below.

Accordingly, an aspect of the present disclosure is to provide an electronic device which may reduce influence of a dielectric substance upon radiating a millimeter wave signal by blocking a component(s), which is radiated in a direction of reducing radiation performance of an antenna, from among components of the millimeter wave signal radiated from the antenna.

In accordance with an aspect of the present disclosure, an electronic device according to an embodiment may include a housing that includes a front surface comprising a dielectric substance having a first permittivity, a rear surface comprising a dielectric substance having a second permittivity, the rear surface facing away from the front surface, and a side surface surrounding a space between the front surface and the rear surface, an antenna array positioned adjacent to the side surface and configured to radiate a millimeter wave signal, the antenna array including at least one antenna element, a communication circuit electrically connected with the antenna array and configured to communicate by using the millimeter wave signal, and an electrical element positioned to be spaced from the antenna array by a specified distance such that a radiation pattern of the millimeter wave signal radiated from the antenna array has a directivity toward the side surface.

According to various embodiments of the disclosure, an electronic device may reduce influence of a housing formed of a dielectric substance upon radiating a millimeter wave signal. For example, the electronic device may allow a radiation pattern of the millimeter wave signal to have directivity in a target direction. Also, the electronic device may reduce distortion of the radiation pattern due to the housing, thereby making is possible to improve communication performance of the electronic device. Besides, a variety of effects directly or indirectly understood through this disclosure may be provided.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
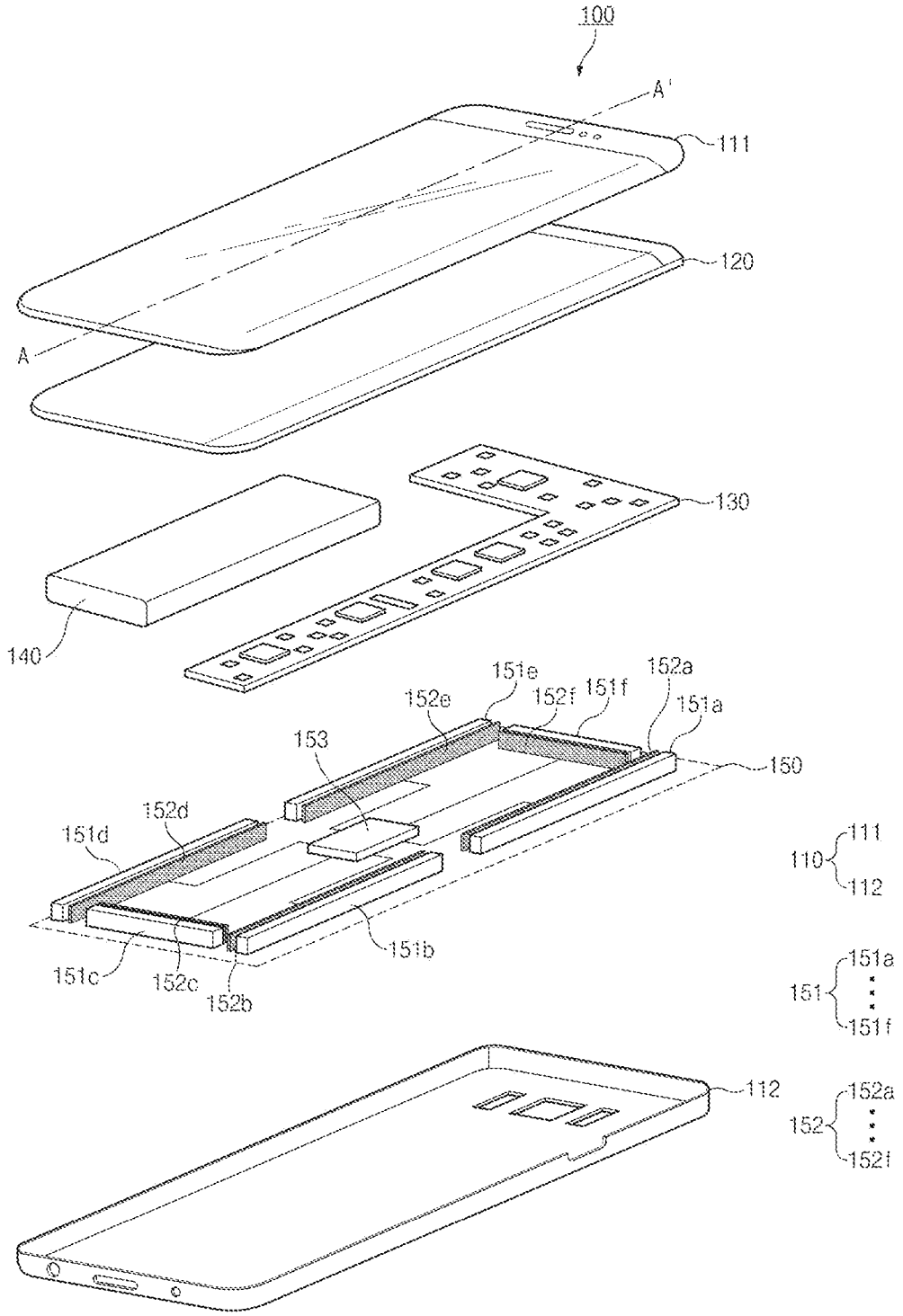
FIG. 1 is an exploded perspective view of an electronic device according to an embodiment of the disclosure.

FIG. 1 is an exploded perspective view of an electronic device according to an embodiment of the disclosure.

Referring to FIG. 1, an electronic device 100 may include a cover glass 111, a rear cover 112, a display 120, a printed circuit board 130, a battery 140, or a communication system 150.

According to an embodiment of the disclosure, the cover glass 111 and the rear cover 112 may be coupled with each other to form a housing 110. The housing 110 may form the appearance of the electronic device 100, and may protect internal components of the electronic device 100 from external impact.

According to an embodiment of the disclosure, the housing 110 may include a front surface, a rear surface facing away from the front surface, and a side surface surrounding a space between the front surface and the rear surface. In an embodiment, the side surface may include a first side surface and a second side surface. The first side surface may be a region which is bent and extended toward the rear surface from the front surface. The second side surface may be a region which is bent and extended toward the front surface from the rear surface.

According to various embodiments of the disclosure, a shape of the housing 110 may be at least one of a quadrangle, a substantial quadrangle, a circle, and an ellipse. For example, the housing 110 may be in the shape of a quadrangle or a substantial quadrangle including a first edge, a second edge facing away from the first edge, a third edge connecting one end of the first edge and one end of the second edge, and a fourth edge connecting an opposite end of the first edge and an opposite end of the second edge, when viewed from the front surface.

According to various embodiments of the disclosure, the shape of the side surface may be various. For example, the cross section of the side surface may be in the shape of a semicircle. For another example, the cross section of the side surface may be in the shape of a triangle. For another example, the cross section of the side surface may be in the shape of a quadrangle.

According to an embodiment of the disclosure, the front surface and the first side surface extended from the front surface may be formed of the cover glass 111, and the rear surface and the second side surface extended from the rear surface may be formed of the rear cover 112. For another embodiment, the front surface may be formed of the cover glass 111, and the rear surface, the first side surface, and the second side surface may be formed of the rear cover 112.

According to an embodiment of the disclosure, at least a portion of the first side surface and the second side surface may be formed of a conductor. For example, the conductor may include a metal material such as aluminum (Al), stainless steel, or the like. In this case, at least a portion of the first side surface and the second side surface may be formed of, for example, a metal frame which is distinguished from the front surface and the rear surface of the housing 110. For example, the housing 110 may include the cover glass 111 corresponding to the front surface, the rear cover 112 corresponding to the rear surface, and the metal frame corresponding to the side surface.

According to an embodiment of the disclosure, at least a portion of the cover glass 111 and the rear cover 112 may be formed of a dielectric substance having permittivity of a specified magnitude. For example, the cover glass 111 may be formed of a dielectric substance having first permittivity, and the rear cover 112 may be formed of a second dielectric substance having second permittivity. In an embodiment, the first permittivity may be identical to the second permittivity.

According to an embodiment of the disclosure, the display 120 may be interposed between the cover glass 111 and the rear cover 112. The display 120 may be electrically connected with the printed circuit board 130, and may output content (e.g., a text, an image, a video, an icon, a widget, a symbol, or the like) or may receive a touch input (e.g., a touch, a gesture, a hovering, or the like) from the user.

According to an embodiment of the disclosure, various electronic parts, various elements, various printed circuits, or the like of the electronic device 100 may be mounted on the printed circuit board 130. For example, an application processor (AP), a communication processor (CP), a memory, or the like may be mounted on the printed circuit board 130. In the disclosure, the printed circuit board 130 may be referred to as a "first printed circuit board" (PCB), a "main PCB", a "main board", or a "printed board assembly" (PBA).

According to an embodiment of the disclosure, the battery 140 may convert chemical energy and electrical energy bidirectionally. For example, the battery 140 may convert chemical energy into electrical energy and may supply the converted electrical energy to the display 120 and various components or modules mounted on the printed circuit board 130. For another example, the battery 140 may convert and store electrical energy supplied from the outside into chemical energy. According to an embodiment, a power management module for managing the charging and discharging of the battery 140 may be included in the printed circuit board 130.

According to an embodiment of the disclosure, the communication system 150 may be interposed between the printed circuit board 130 and the rear cover 112. According to an embodiment, an adhesive material may be interposed between the communication system 150 and the rear cover 112, and thus, the communication system 150 may be attached to the rear cover 112. In the disclosure, the communication system 150 may be referred to as a "5G module PCB".

The communication system 150 may include a communication device 151, an electrical element 152, and a communication module 153. According to various embodiments, the communication system 150 is not limited to illustration of FIG. 1. For example, unlike the illustration of FIG. 1, the communication system 150 may include a plurality of communication devices 151. For example, the communication system 150 may include at least one communication device 151, or may include two or more communication devices 151 (e.g., four communication devices 151). The communication device 151 may be positioned in various forms, unlike the illustration of FIG. 1. For another example, the size and layout of electronic elements 152*a*, 152*b*, 152*c*, 152*d*, 152*e*, and 152*f* may be different from those illustrated in FIG. 1.

According to an embodiment of the disclosure, the communication module 153 may include a communication processor (CP), a radio frequency integrated circuit (RF IC), and/or an intermediate frequency integrated circuit (IF IC). According to another embodiment, the communication module 153 may include the IF IC, and the RF IC may be included in the communication device 151.

According to an embodiment of the disclosure, the communication module 153 may be electrically connected with the communication device 151 and may feed the communication device 151. In the disclosure, "feed" (or "feeding") may mean an operation in which the communication module 153 applies a current to the communication device 151.

In an embodiment of the disclosure, the communication module 153 may communicate with an external electronic device or a base station through a millimeter wave signal by feeding the communication device 151. The millimeter wave signal may be understood, for example, as s signal, a wavelength of which is a millimeter unit, or a signal having a frequency of a band ranging from 20 GHz to 100 GHz.

According to an embodiment of the disclosure, the communication device 151 may include a plurality of communication devices 151*a*, 151*b*, 151*c*, 151*d*, 151*e*, and 151*f*. According to an embodiment of the disclosure, the communication device 151 may be positioned adjacent to a periphery of the electronic device 100, for example, the side surface of the housing 110.

For example, in the case where the housing 110 is in the shape of a quadrangle or a substantial quadrangle including a first edge, a second edge, a third edge, and a fourth edge, a communication device may include the first communication device 151*a* positioned adjacent to the first edge, the second communication device 151*c* positioned adjacent to the second edge, the third communication device 151*d* positioned adjacent to the third edge, and the fourth communication device 151*f* positioned adjacent to the fourth edge.

For another example, as illustrated in FIG. 1, the communication device 151 may further include the fifth communication device 151*b* positioned adjacent to the first edge and the sixth communication device 151*e* positioned adjacent to the second edge.

For another example, in the case where the housing 110 is in the shape of a circle, the communication device 151 may include the plurality of communication devices 151 which are positioned to be spaced from the center of the circle by a specified distance toward the side surface.

In an embodiment of the disclosure, the communication device 151 may radiate a millimeter wave signal toward the outside of the electronic device 100. The electronic device 100 may communicate with a base station or an external electronic device through the radiated millimeter wave signal.

According to an embodiment of the disclosure, the communication device 151 may include an antenna array including a plurality of antenna elements. According to an embodiment, the antenna elements included in the antenna array may form an omni-directional radiation pattern in a free space. The free space may be understood, for example, as a space which consists of only a dielectric substance having permittivity of "1".

According to an embodiment of the disclosure, in the case where the antenna array including the antenna elements is positioned within the housing 110 of the electronic device 100, not in the free space, the antenna array may form a radiation pattern different from the omni-directional radiation pattern due to various components (e.g., the electrical element 152) positioned within the electronic device 100. For example, the antenna array may form a radiation pattern having directivity toward the side surface of the housing 110 at the inside of the electronic device 100. If the antenna array forms a radiation pattern having directivity in a specific direction, communication performance of the electronic device 100 in the specific direction may be improved.

According to an embodiment of the disclosure, the electrical element 152 may be positioned to be spaced from the communication device 151 by a specified distance. For example, the electrical element 152 may be positioned to be spaced from the communication device 151 by a specified distance in an inward direction (or toward the inside) of the electronic device 100. The inward direction may be understood as a direction which is opposite to a direction facing the side surface at the inside of the housing 110. For another example, the electrical element 152 may be positioned to be spaced from the communication device 151 by a specified distance toward the rear surface of the housing 110.

According to an embodiment of the disclosure, the electrical element 152 may be positioned in such a way that a radiation pattern of a millimeter wave signal radiated from the communication device 151 has directivity in a specific direction. For example, the electrical element 152 may be positioned to allow the radiation pattern to have directivity toward the side surface of the housing 110.

According to an embodiment of the disclosure, the electrical element 152 may make a component, which arrives at the front surface or the rear surface of the housing 110, of the millimeter wave signal smaller than a specified intensity. For example, the electrical element 152 may absorb, reflect, or shield the component.

According to an embodiment of the disclosure, in the case where the millimeter wave signal having a greater intensity than a specified level reaches a dielectric substance having a thickness of a specified level or greater compared to a wavelength, the second radiation may be made from the dielectric substance. The second radiation may be based on the first radiation of the millimeter wave signal made by the communication device 151.

According to an embodiment of the disclosure, in the case where the intensity of the millimeter wave signal which arrives at the front surface or the rear surface of the housing 110 becomes smaller than the specified level due to the electrical element 152, the intensity of the second radiation which may come from the dielectric substance (e.g., the front surface or the rear surface of the housing 110) may become smaller than the specified level, or the second radiation may not be made. In this case, influence of the second radiation on the first radiation of the millimeter wave signal made at the communication device 151 may be smaller than the specified level. For example, a radiation pattern of the millimeter wave signal radiated from the communication device 151 may be protected against distortion due to the dielectric substance.

According to an embodiment of the disclosure, since a component, which is radiated toward the side surface of the housing 110, of the millimeter wave signal is not absorbed, reflected, or shielded, the component of the millimeter wave signal may be greater than a specified intensity. In an embodiment, since the component radiated toward the side surface may be greater than the specified intensity, the second radiation of the millimeter wave signal may be made on the side of the housing 110. A null region may be present in a portion of a radiation pattern by the second radiation, and a portion of the radiation pattern may be distorted by the null region. However, the portion of the radiation pattern, in which the null region occurs, may not be associated with a target direction in which the electronic device 100 intends to communicate through radiation of the millimeter wave signal. For example, the target direction may be a lateral direction of the electronic device 100, and the null region may occur toward the front surface or the rear surface of the electronic device 100.

As a result, the radiation pattern of the millimeter wave signal may have directivity in the lateral direction of the housing 110 being the target direction, and the distortion may not occur at the radiation pattern oriented in the target direction.

According to an embodiment of the disclosure, a width of the electrical element 152 may be wider than a width of an antenna element. For example, the width of the electrical element 152 may be greater than a first distance 21 illustrated in FIG. 2B. The first distance 21 may be, for example, identical or similar to one-half a wavelength of a millimeter wave signal radiated through an antenna element. In an embodiment, if the width of the electrical element 152 is greater than the first distance 21, a millimeter wave signal radiated toward the electrical element 152 from the antenna element may be effectively blocked.

According to various embodiments of the disclosure, the electrical element 152 may include a wave absorber, a reflection member, and a ground member.

In an embodiment of the disclosure, the wave absorber may absorb a portion of a component, which is radiated toward the front surface or the rear surface of the housing 110, of a millimeter wave signal radiated from the communication device 151. For example, the wave absorber may be formed of ferrite, iron, brass, or an alloy thereof.

In another embodiment of the disclosure, the reflection member may reflect a portion of a component, which is radiated toward the front surface or the rear surface of the housing 110, of a millimeter wave signal radiated from the communication device 151. For example, the reflection member may be formed of metal, such as aluminum, zinc, or magnesium, or an alloy thereof.

In another embodiment of the disclosure, the ground member may shield a portion of a component, which is radiated toward the front surface or the rear surface of the housing 110, of a millimeter wave signal radiated from the communication device 151.

According to an embodiment of the disclosure, the antenna array included in the communication device 151 may include a dipole antenna array. According to an embodiment, the electronic device 100 may further include a patch antenna array electrically connected with the communication module 153. For example, the communication device 151 may further include the patch antenna array.

In an embodiment of the disclosure, the patch antenna array may radiate a millimeter wave signal in a direction different from (e.g., perpendicular to) a direction in which the dipole antenna array radiates a signal. For example, the dipole antenna array may radiate a millimeter wave signal toward the side surface of the housing 110, and the patch antenna array may radiate a millimeter wave signal toward the front surface or the rear surface of the housing 110.

According to an embodiment, the dipole antenna array may radiate a signal including a first frequency band, and the patch antenna array a signal including a second frequency band. According to an embodiment, the first frequency band may be identical to the second frequency band.

In the disclosure, the description given with reference to FIG. 1 may be identically applied to components having the same reference numerals/marks as the components of the electronic device 100 described with reference to FIG. 1.

Figure 2A:
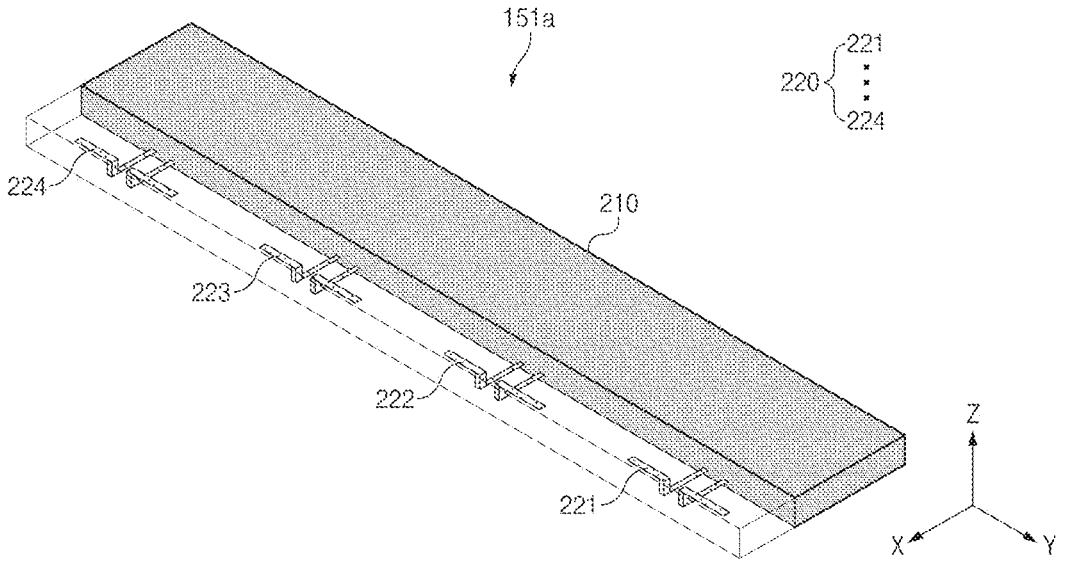
FIG. 2A is a perspective view of a communication device included in an electronic device according to an embodiment of the disclosure.

FIG. 2A is a perspective view of a communication device included in an electronic device according to an embodiment of the disclosure.

Figure 2B:
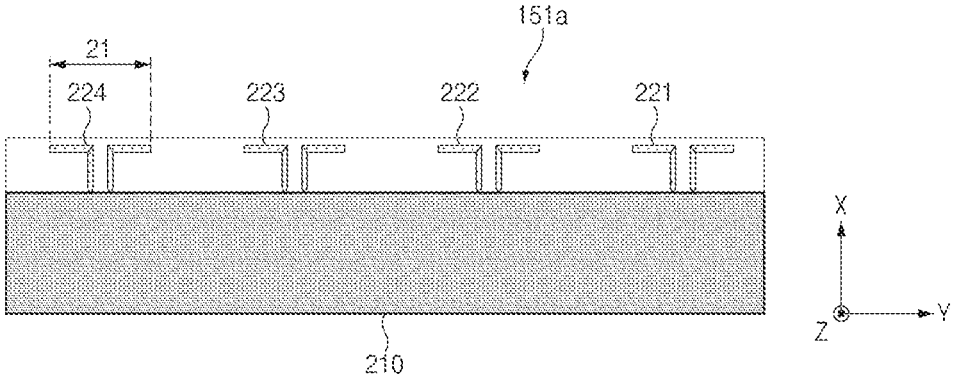
FIG. 2B is a plan view of a communication device included in an electronic device according to an embodiment of the disclosure.

FIG. 2B is a plan view of a communication device included in an electronic device according to an embodiment of the disclosure.

Figure 2C:
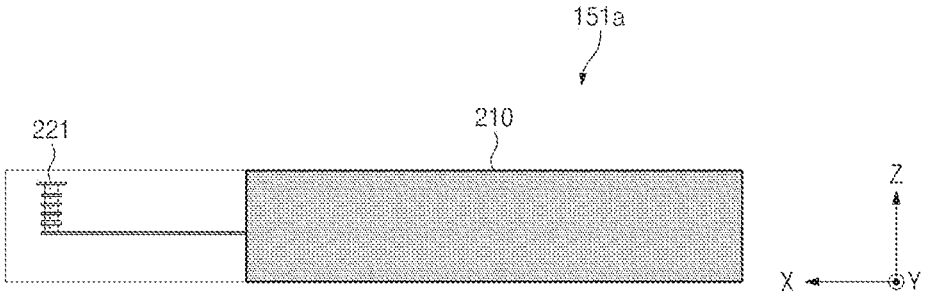
FIG. 2C is a lateral view of a communication device included in an electronic device according to an embodiment of the disclosure.

FIG. 2C is a lateral view of a communication device included in an electronic device according to an embodiment of the disclosure.

Referring to FIGS. 2A to 2C, a communication device 151*a* may include a printed circuit board 210 and a plurality of antenna elements 221, 222, 223, and 224. The plurality of antenna elements 221, 222, 223, and 224 may form an antenna array 220.

According to an embodiment of the disclosure, the printed circuit board 210 may be configured to mount the plurality of antenna elements 221, 222, 223, and 224. According to an embodiment, the plurality of antenna elements 221, 222, 223, and 224 may be arranged at a specified interval at one end of the printed circuit board 210. In the disclosure, the printed circuit board 210 may be referred to as a "5G module PCB" or a "second PCB".

According to an embodiment of the disclosure, wirings for feeding the plurality of antenna elements 221, 222, 223, and 224 may be positioned at the printed circuit board 210. Through the wirings, the plurality of antenna elements 221, 222, 223, and 224 may be electrically connected with the communication module 153 and may be fed.

According to an embodiment of the disclosure, a plurality of electrical elements may be positioned at the printed circuit board 210, and the printed circuit board 210 may include a ground for the plurality of electrical elements. In an embodiment, the ground may identically or similarly function as the electrical element 152 illustrated in FIG. 1.

For example, the ground may shield at least a portion of a millimeter wave signal radiated from the antenna elements 221, 222, 223, and 224, for example, a component radiated toward the printed circuit board 210. In this case, the millimeter wave signal may not arrive at a dielectric substance present in a direction of the printed circuit board 210, for example, at a partial region of the front surface of the housing 110 or a partial region of the rear surface of the housing 110.

According to an embodiment of the disclosure, the antenna elements 221, 222, 223, and 224 may be fed from the communication module 153 and may form a beam for radiating a millimeter wave signal. According to an embodiment, the antenna elements 221, 222, 223, and 224 may be a dipole antenna. For example, the antenna elements 221, 222, 223, and 224 may form a beam so as to have an omni-directional radiation pattern in a horizontal direction in a free space (e.g., a space in which permittivity is "1"). According to another embodiment, the antenna elements 221, 222, 223, and 224 may be a monopole antenna, unlike illustration of FIGS. 2A to 2C.

In FIGS. 2A to 2C, a shape of the communication device 151*a*, a configuration of an antenna array, the number of the antenna elements 221, 222, 223, and 224, locations of the antenna elements 221, 222, 223, and 224, and the like are exemplary, and the embodiments of the disclosure are not limited to the illustration of FIGS. 2A to 2C. Also, in the disclosure, the description given with reference to the communication device 151*a* illustrated in FIGS. 2A to 2C may be identically or similarly applied to the second communication device 151*b* to the sixth communication device 151*f*.

Also, in the disclosure, the description given with reference to FIGS. 2A to 2C may be identically applied to components having the same reference numerals/marks as the components of the communication device 151*a* described with reference to FIGS. 2A to 2C.

FIGS. 3A to 3D are views illustrating an electronic device including an electrical element according to various embodiments of the disclosure. FIGS. 3A to 3D show a part of a cross section taken along a line A-A', for example, in a state where an electronic device illustrated in FIG. 1 is assembled.

Figure 3A:
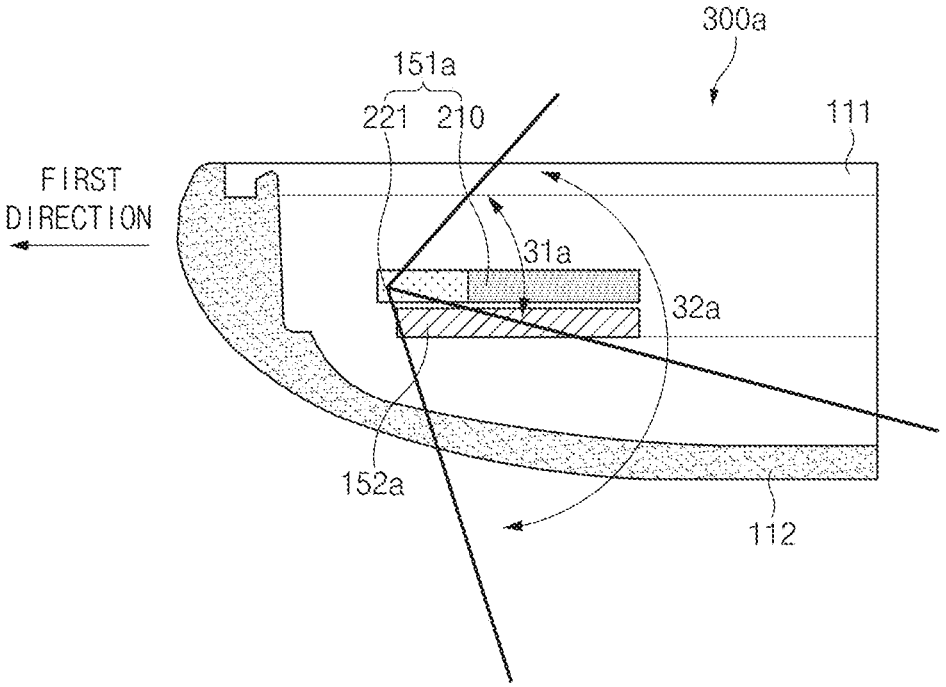
FIGS. 3A, 3B, 3C and 3D are views illustrating an electronic device including an electrical element according to various embodiments of the disclosure.

Referring to FIG. 3A, an electronic device 300*a* may include the cover glass 111, the rear cover 112, the communication device 151*a*, and the electrical element 152*a*. According to various embodiments, the electronic device 300*a* may further include a component not illustrated in FIG. 3A. For example, the electronic device 300*a* may further include the communication module 153 electrically connected with the communication device 151*a*.

In various embodiments of the disclosure, a target direction in which the electronic device 300*a* intends to communicate through a millimeter wave signal may be a first direction. A configuration of the electronic device 300*a* illustrated in FIG. 3A may be identical or similar to configurations of electronic devices 300*b*, 300*c*, and 300*d* illustrated in FIGS. 3B, 3C, and 3D.

Figure 3B:
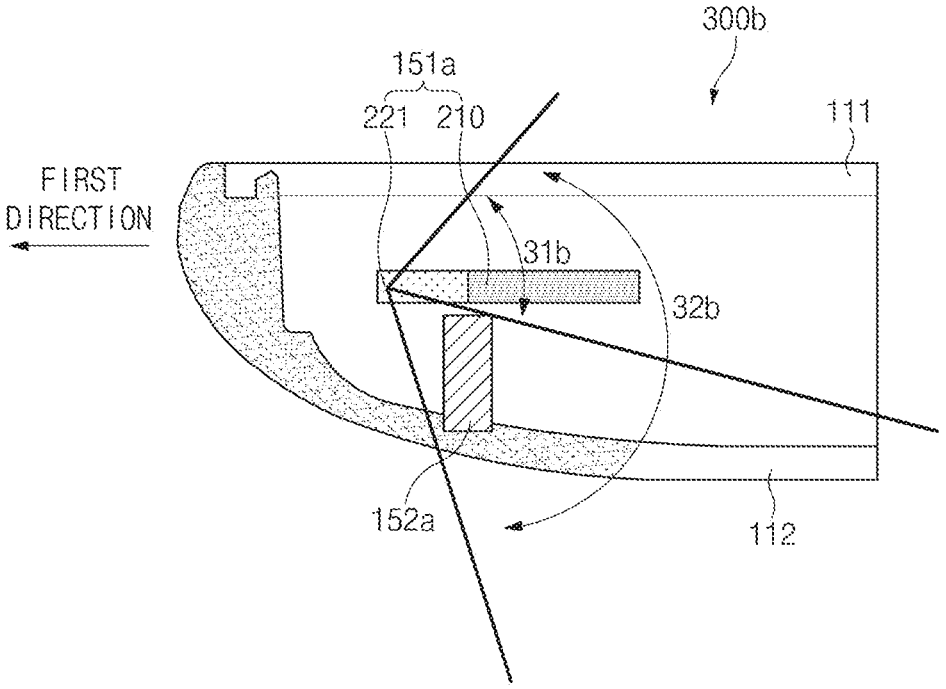

Referring to FIGS. 3A and 3B, the communication device 151*a* may be positioned parallel or substantially parallel to the front surface and the rear surface of the housing 110. For example, the antenna elements 221, 222, 223, and 224 included in the communication device 151*a* may be extended and mounted in a lateral direction of the housing 110 from the printed circuit board 210.

According to an embodiment of the disclosure, the ground included in the printed circuit board 210 may shield at least a portion of a millimeter wave signal radiated from the antenna elements 221, 222, 223, and 224, for example, a component radiated toward the printed circuit board 210. For example, a first region 31*a* or 31*b* may indicate a blocking region in which a millimeter wave signal is blocked by the printed circuit board 210. A component, which belongs to a direction of the cover glass 111 and the rear cover 112 corresponding to the first region 31*a* or 31*b*, of the millimeter wave signal may be blocked.

According to an embodiment of the disclosure, the electrical element 152*a* may be positioned parallel or substantially parallel to the communication device 151*a*. For example, as illustrated in FIG. 3A, the electrical element 152*a* may be spaced from the communication device 151*a* by a specified distance toward the rear cover 112 and may be positioned parallel or substantially parallel to the communication device 151*a*.

According to another embodiment of the disclosure, the electrical element 152*a* may be positioned perpendicular or substantially perpendicular to the communication device 151*a*. For example, as illustrated in FIG. 3B, the electrical element 152*a* may be spaced from the communication device 151*a* by a specified distance toward the rear cover 112 and may be positioned perpendicular or substantially perpendicular to the communication device 151*a*.

In various embodiments, the electrical element 152*a* may be implemented with a wave absorber, a reflection member, or a ground member. According to an embodiment, a width of the electrical element 152*a* may be longer in length than a width of the respective antenna elements 221, 222, 223, and 224.

According to an embodiment of the disclosure, the electrical element 152*a* may absorb, reflect, or shield at least a portion of a millimeter wave signal radiated from the antenna elements 221, 222, 223, and 224, for example, a component radiated toward the electrical element 152*a*. For example, a second region 32*a* or 32*b* may indicate a blocking region in which a millimeter wave signal is blocked by the electrical element 152*a*. In an embodiment, the second region 32*a* or 32*b* may include the first region 31*a* or 31*b*. In an embodiment, a width of the second region 32*a* or 32*b* may vary with a length, a thickness, or a location of the electrical element 152*a*.

According to various embodiments of the disclosure, a component, which is radiated in a direction except for the target direction, of a millimeter wave signal radiated from the antenna elements 221, 222, 223, and 224 may be blocked to a specified level or lower by the electrical element 152*a* and a ground included in the printed circuit board 210. As such, the electronic device 300*a* or 300*b* may allow the millimeter wave signal to form a radiation pattern having directivity in the target direction.

Figure 3C:
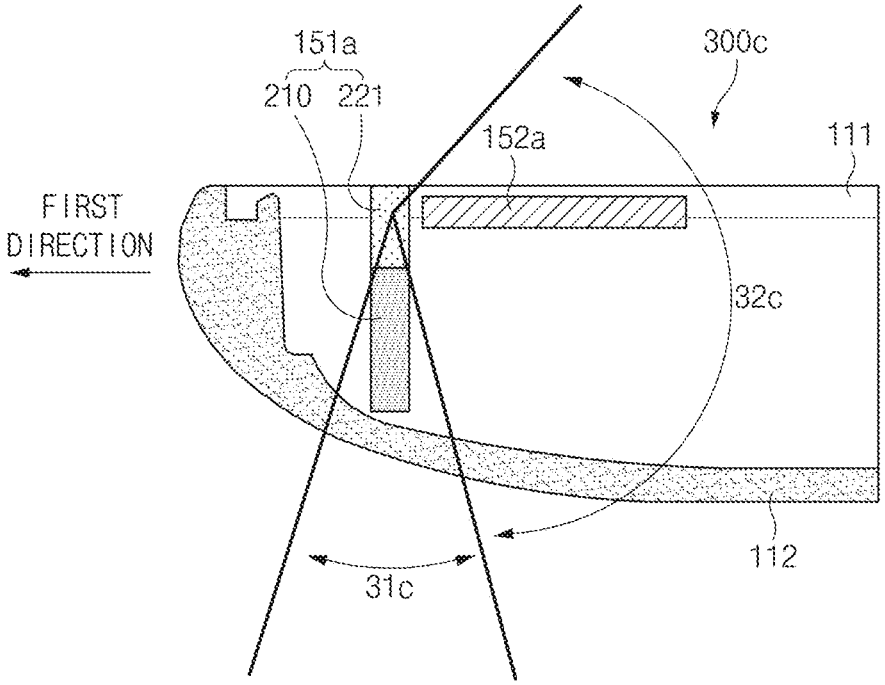
Figure 3D:
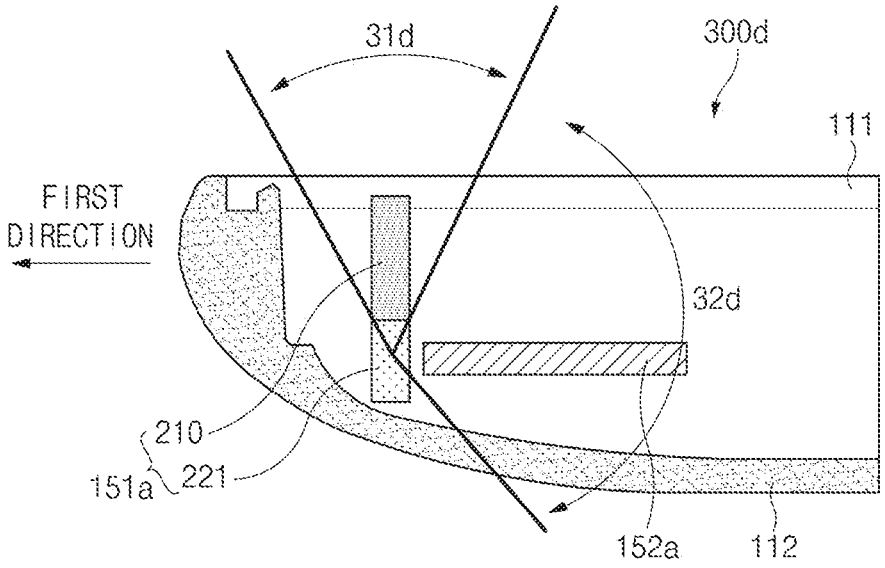

Referring to FIGS. 3C and 3D, the communication device 151*a* may be positioned perpendicular or substantially perpendicular to the front surface and the rear surface of the housing 110. For example, as illustrated in FIG. 3C, the antenna elements 221, 222, 223, and 224 included in the communication device 151*a* may be extended and mounted toward the front surface of the housing 110 from the printed circuit board 210. For another example, as illustrated in FIG. 3D, the antenna elements 221, 222, 223, and 224 included in the communication device 151*a* may be extended and mounted toward the rear surface of the housing 110 from the printed circuit board 210. The description given with reference to FIGS. 3A and 3B will be omitted upon describing FIGS. 3C and 3D to avoid redundancy.

According to an embodiment of the disclosure, the ground included in the printed circuit board 210 may shield at least a portion of a millimeter wave signal radiated from the antenna elements 221, 222, 223, and 224, for example, a component radiated toward the printed circuit board 210. For example, a component, which belongs to a direction corresponding to a first region 31*c* or 31*d*, of the millimeter wave signal may be blocked. In an embodiment, as illustrated in FIG. 3C, the first region 31*c* may include a direction of the rear cover 112. In another embodiment, as illustrated in FIG. 3D, the first region 31*d* may include a direction of the cover glass 111.

According to another embodiment of the disclosure, the electrical element 152*a* may be positioned perpendicular or substantially perpendicular to the communication device 151*a*. For example, as illustrated in FIGS. 3C and 3D, the electrical element 152*a* may be spaced from the communication device 151*a* by a specified distance and may be positioned perpendicular or substantially perpendicular to the communication device 151*a*. In this case, the electrical element 152*a* may be positioned adjacent to any one of the antenna element 221, 222, 223, or 224 of the communication device 151*a*. Although not illustrated, according to another embodiment of the disclosure, the electrical element 152*a* may be positioned parallel or substantially parallel to the communication device 151*a*.

According to an embodiment, a second region 32*c* or 32*d* may indicate a blocking region in which a millimeter wave signal is blocked by the electrical element 152*a*. According to an embodiment, the second region 32*c* or 32*d* may not include the first region 31*c* or 31*d*.

According to various embodiments of the disclosure, if the communication device 151*a* is perpendicular or substantially perpendicular to the rear cover 112 as illustrated in FIGS. 3C and 3D, a region where a millimeter wave signal is blocked may be wider compared to the case where the communication device 151*a* is parallel or substantially parallel to the rear cover 112 as illustrated in FIGS. 3A and 3B.

According to various embodiments of the disclosure, the layout of the communication device 151*a* and the electrical element 152*a* is not limited to illustration of FIGS. 3A to 3D. For example, the communication device 151*a* and the electrical element 152*a* may be positioned in various forms depending on an internal mounting space of an electronic device, and a region where a millimeter wave signal is blocked may also vary with the layout.

Figure 4A:
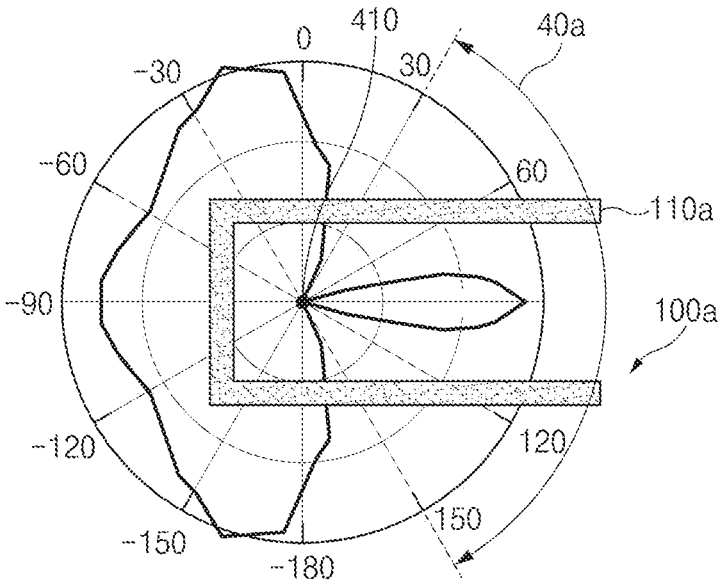
FIG. 4A is a view illustrating a radiation pattern of an electronic device including a housing, a side surface of which has a rectangular cross section, according to an embodiment of the disclosure.

FIG. 4A is a view illustrating a radiation pattern of an electronic device including a housing, a side surface of which has a rectangular cross section, according to an embodiment of the disclosure.

Figure 4B:
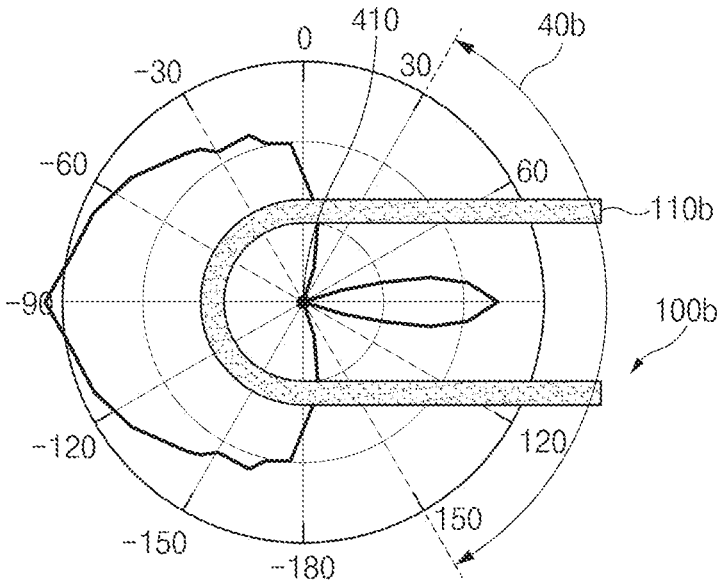
FIG. 4B is a view illustrating a radiation pattern of an electronic device including a housing, a side surface of which has a semicircular cross section, according to an embodiment of the disclosure.

FIG. 4B is a view illustrating a radiation pattern of an electronic device including a housing, a side surface of which has a semicircular cross section, according to an embodiment of the disclosure.

Figure 4C:
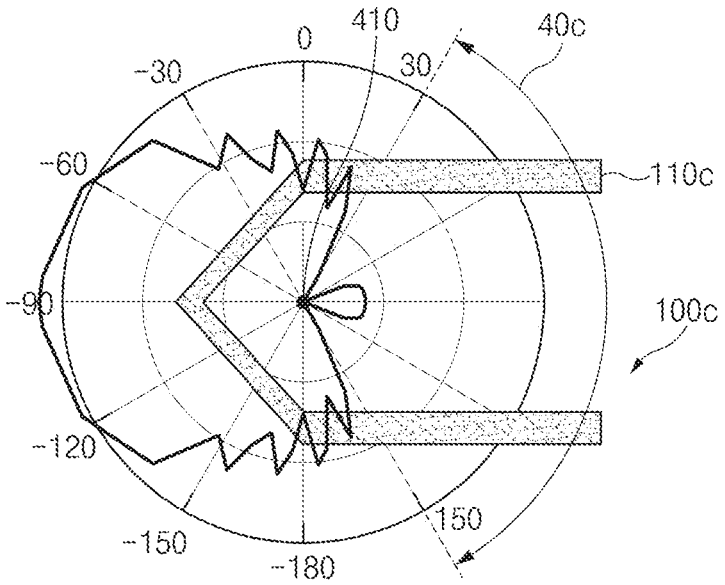
FIG. 4C is a view illustrating a radiation pattern of an electronic device including a housing, a side surface of which has a triangular cross section, according to an embodiment of the disclosure.

FIG. 4C is a view illustrating a radiation pattern of an electronic device including a housing, a side surface of which has a triangular cross section, according to an embodiment of the disclosure.

Referring to FIG. 4A, an electronic device 100*a* may include a housing 110*a* where a cross section of a side surface is rectangular. A millimeter wave signal may be radiated from an antenna element 410 of the electronic device 100*a*. According to an embodiment, the antenna element 410 may radiate a signal so as to have an omni-directional radiation pattern in a free space.

According to an embodiment, of the disclosure a radiation pattern of the electronic device 100*a* may include a first region 40*a* where a millimeter wave signal is blocked to a specified level or lower. The millimeter wave signal may not arrive at the housing 110*a* corresponding to the first region 40*a*. Accordingly, a portion of the housing 110*a* corresponding to the first region 40*a* may have no influence on the millimeter wave signal. As a result, it may be observed that a radiation pattern has directivity in a lateral direction and is almost not distorted.

According to an embodiment of the disclosure, influence of a dielectric substance in a region where a millimeter wave is vertically incident onto the housing 110*a* may be smaller than in a region where a millimeter wave is obliquely incident. Accordingly, as illustrated in FIG. 4A, a gain associated with radiation made toward the vertically incident region may be relatively great.

Referring to FIG. 4B, an electronic device 100*b* may include a housing 110*b* where a cross section of a side surface is semicircular. A radiation pattern of the electronic device 100*b* may include a first region 40*b* where a millimeter wave signal is blocked to a specified level or lower.

According to an embodiment of the disclosure, if the cross section of the side surface is semicircular, a millimeter wave signal radiated from the antenna element 410 may be vertically incident onto a dielectric substance in all directions. Accordingly, in this case, it may be observed that a radiation pattern has a high gain evenly in all directions and is almost not distorted.

Referring to FIG. 4C, an electronic device 100*c* may include a housing 110*c* where a cross section of a side surface is triangular. A radiation pattern of the electronic device 100*c* may include a first region 40*c* where a millimeter wave signal is blocked to a specified level or lower.

According to an embodiment of the disclosure, if the cross section of the side surface is triangular, a millimeter wave signal radiated from the antenna element 410 may be obliquely incident in a partial region. Since a region adjacent to a cover glass and a rear cover is a region in which a millimeter wave signal is obliquely incident, it may be observed that a gain associated with radiation made in the region decreases compared to FIG. 4A.

According to an embodiment of the disclosure, with regard to the electronic device 100*c*, a dielectric substance of a region where the millimeter wave signal is obliquely incident may be relatively close to the antenna element 410, compared to the electronic device 100*a*. In this case, the dielectric substance may affect a radiation pattern, thereby causing distortion of the radiation pattern. It may be observed from FIG. 4C that a radiation pattern is somewhat distorted.

Figure 5:
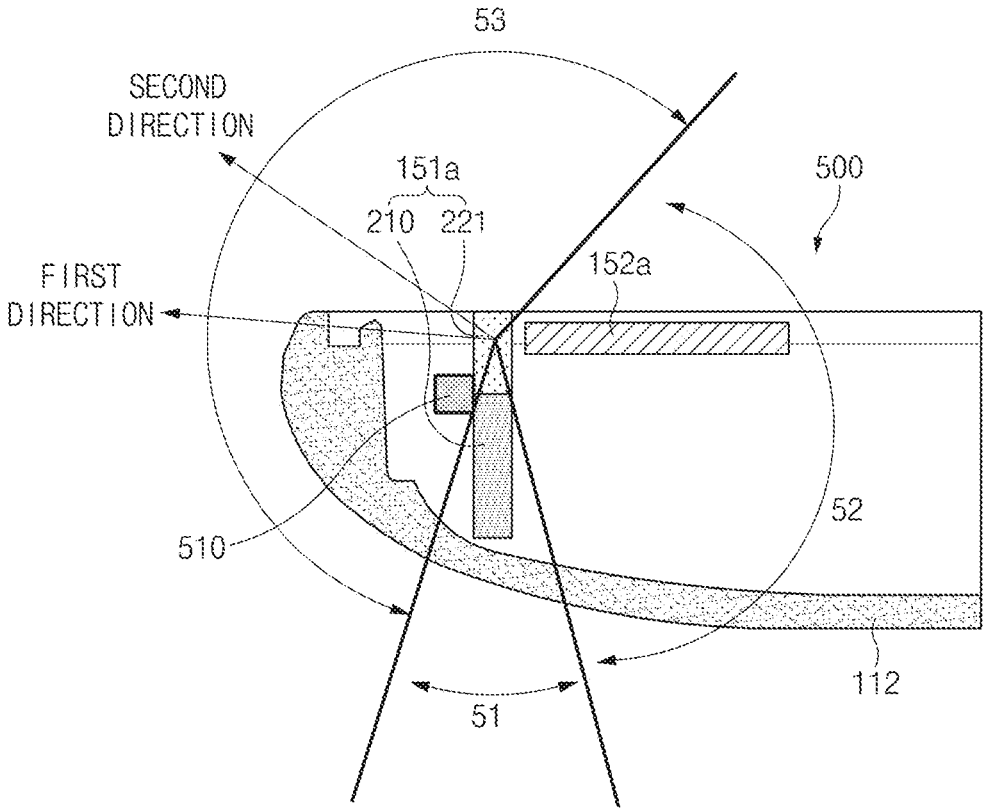
FIG. 5 is a view illustrating an electronic device including a plurality of electrical elements according to an embodiment of the disclosure.

FIG. 5 is a view illustrating an electronic device including a plurality of electrical elements according to an embodiment of the disclosure.

Referring to FIG. 5, an electronic device 500 may include the cover glass 111, the rear cover 112, the communication device 151*a*, the first electrical element 152*a*, and a second electrical element 510.

According to an embodiment of the disclosure, the electronic device 500 may include a region where a millimeter wave signal is blocked to a specified level or lower. For example, the electronic device 500 may include a first region 51 where the millimeter wave signal is blocked to the specified level or lower by the printed circuit board 210 of the communication device 151*a*. For another example, the electronic device 500 may include a second region 52 where the millimeter wave signal is blocked to the specified level or lower by the first electrical element 152*a*.

According to an embodiment of the disclosure, the remaining region other than the first region 51 and the second region 52 may be referred to as a "third region 53" where the millimeter wave signal exceeding the specified level is radiated. According to an embodiment, a direction of the third region 53 may be adjusted. For example, the direction of the third region 53 may be adjusted by changing a length of the second electrical element 510.

According to an embodiment of the disclosure, the second electrical element 510 may be a ground member, the size of which is smaller than a specified size. The ground member may operate as imperfect ground, for example, finite ground. A ground effect of the finite ground may vary with the size. For example, since a ground effect of the finite ground having a small size is small, the degree by which an electromagnetic wave is shielded by the finite ground may be relatively small.

According to an embodiment of the disclosure, the second electrical element 510 may be positioned adjacent to the communication device 151*a*. For example, as illustrated in FIG. 5, the second electrical element 510 may be positioned to be adjacent within a specified distance in a target direction of the electronic device 500 from an antenna element of the communication device 151*a*.

According to an embodiment of the disclosure, a length of the second electrical element 510 may be variously set. For example, in the case where radiation of a millimeter wave signal is hindered by internal components of the electronic device 500, the direction of the third region 53 may be adjusted by adjusting the length of the second electrical element 510. The millimeter wave signal may be radiated in an optimum direction with the avoidance of the direction of the components.

Figure 6:
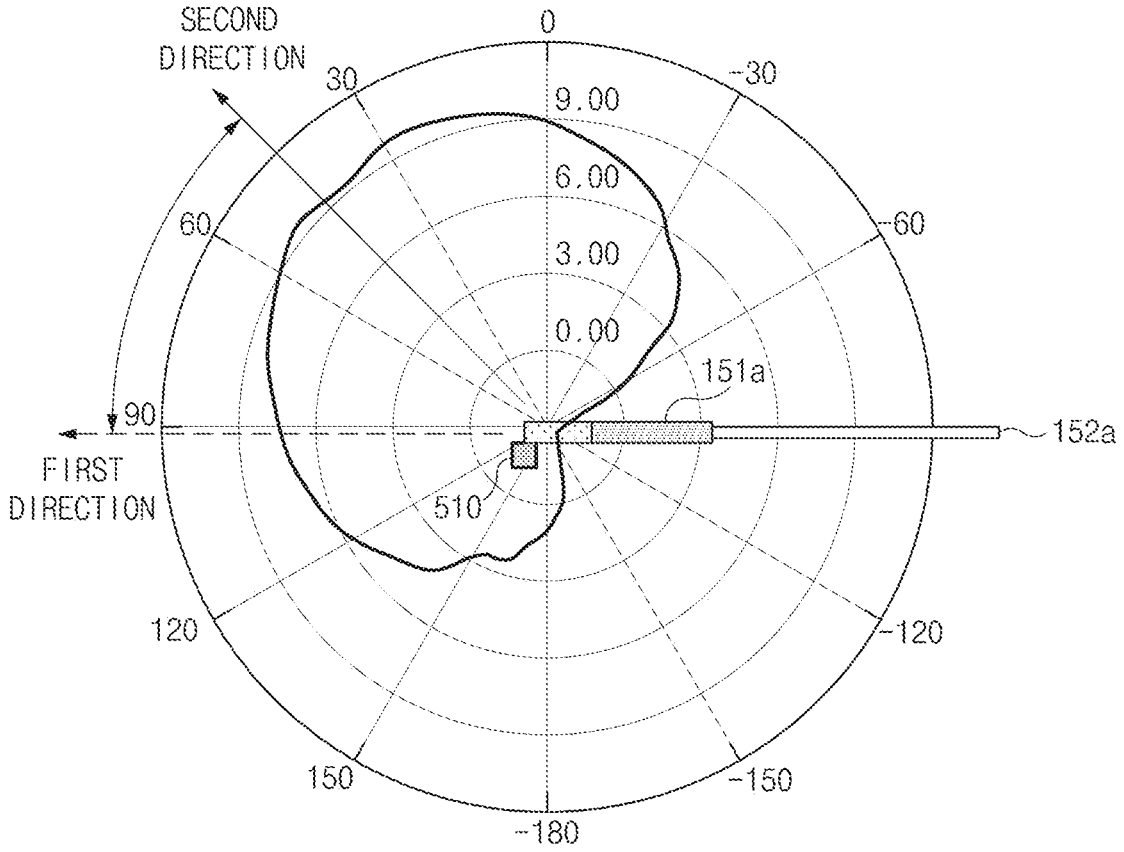
FIG. 6 is a view illustrating a radiation pattern of an electronic device including a plurality of electrical elements according to an embodiment of the disclosure.

FIG. 6 is a view illustrating a radiation pattern of an electronic device including a plurality of electrical elements according to an embodiment of the disclosure.

Referring to FIG. 6, a radiation pattern of an electronic device may have directivity in a specified direction. For example, the radiation pattern may have directivity in a lateral direction of a housing.

According to an embodiment of the disclosure, a direction of a radiation pattern of an electronic device including the first electrical element 152*a* and the second electrical element 510 may be changed by the second electrical element 510. For example, in the case where the second electrical element 510 is not positioned, the direction of the radiation pattern may face the first direction. In the case where the second electrical element 510 is positioned, the direction of the radiation pattern may be changed to a second direction due to influence of the finite ground.

According to an embodiment of the disclosure, as illustrated in FIG. 6, a radiation pattern may have directivity in a direction of approximately 45° and may be formed between approximately −30° and approximately 150°. The size of the radiation pattern may be somewhat small at approximately −30° and approximately 150°, but may maintain 9 dB between 0° and 120°.

Figure 7A:
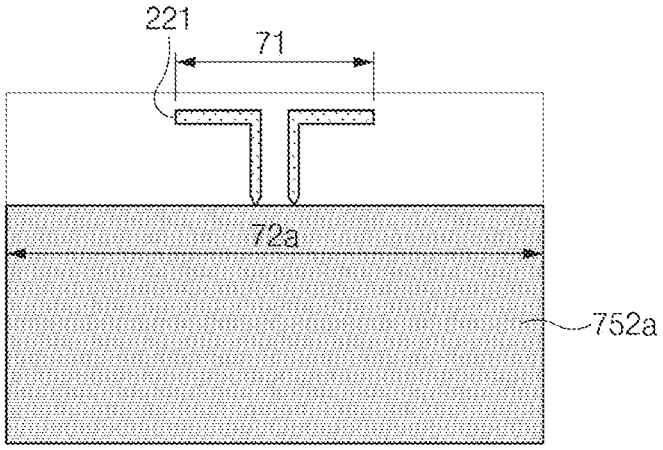
FIG. 7A is a view illustrating a layout of an antenna element and an electrical element, according to an embodiment of the disclosure.

FIG. 7A is a view illustrating a layout of an antenna element and an electrical element, according to an embodiment of the disclosure.

Figure 7B:
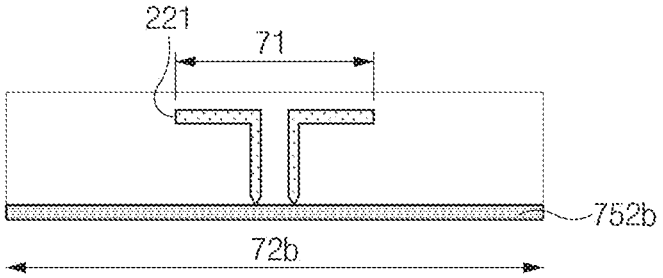
FIG. 7B is a view illustrating a layout of an antenna element and an electrical element, according to an embodiment of the disclosure.

FIG. 7B is a view illustrating a layout of an antenna element and an electrical element, according to another embodiment of the disclosure.

Figure 7C:
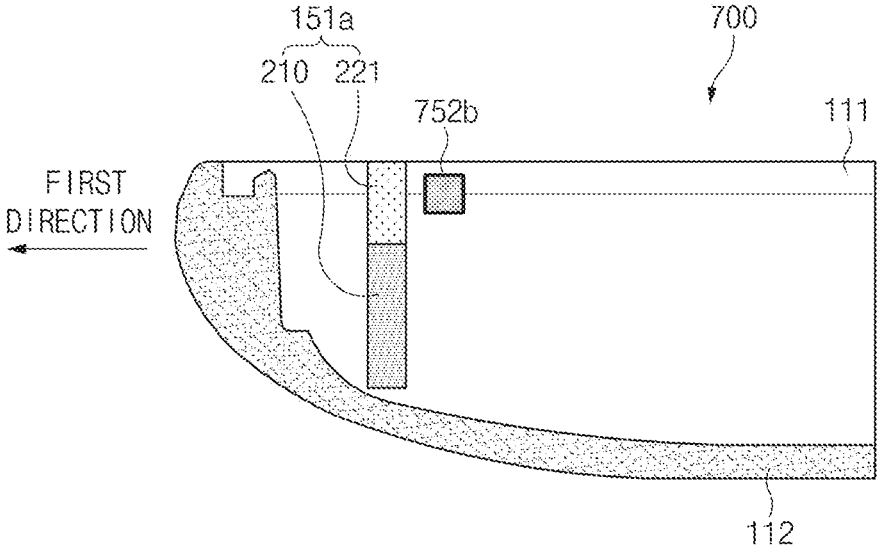
FIG. 7C is a view illustrating an electronic device including an antenna element and an electrical element, according to an embodiment of the disclosure.

FIG. 7C is a view illustrating an electronic device including an antenna element and an electrical element, according to another embodiment of the disclosure.

According to various embodiments of the disclosure, a shape of an electrical element 752*a* or 752*b*, and the layout of the antenna element 221 and the electrical element 752*a* or 752*b* may be observed from FIGS. 7A and 7B.

According to an embodiment of the disclosure, the electrical element 752*a* may be implemented in the shape of a flat panel having a specified thickness from one end of the antenna element 221 as illustrated in FIG. 7A. According to another embodiment, the electrical element 752*b* may be implemented in the shape of a stick (or a line) as illustrated in FIG. 7B.

According to various embodiments of the disclosure, in terms of a mounting area, the stick-shaped electrical element 752*b* may be more advantageous than the flat panel-shaped electrical element 752*a*. According to various embodiments, the flat panel-shaped electrical element 752*a* may perform a wave blocking role more stably than the stick-shaped electrical element 752*b*.

According to an embodiment of the disclosure, a width 72*a* or 72*b* of the electrical element 752*a* or 752*b* may be wider than a width 71 of the antenna element 221. The width 71 of the antenna element 221 may be identical or similar to, for example, one-half a wavelength of a millimeter wave signal radiated through the antenna element 221. In an embodiment, if the width 72*a* or 72*b* of the electrical element 752*a* or 752*b* is wider than the width 71 of the antenna element 221, a millimeter wave signal radiated toward the electrical element 752*a* or 752*b* from the antenna element 221 may be effectively blocked.

A sectional view of an electronic device 700 in which the stick-shaped electrical element 752*b* is mounted is illustrated in FIG. 7C. Since the electrical element 752*b* is implemented in the shape of a stick, as illustrated in FIG. 7C, a mounting space of the electronic device 700 may be saved. In the case where the internal mounting space of the electronic device 700 is insufficient, the stick-shaped electrical element 752*b* may be used.

Figure 8:
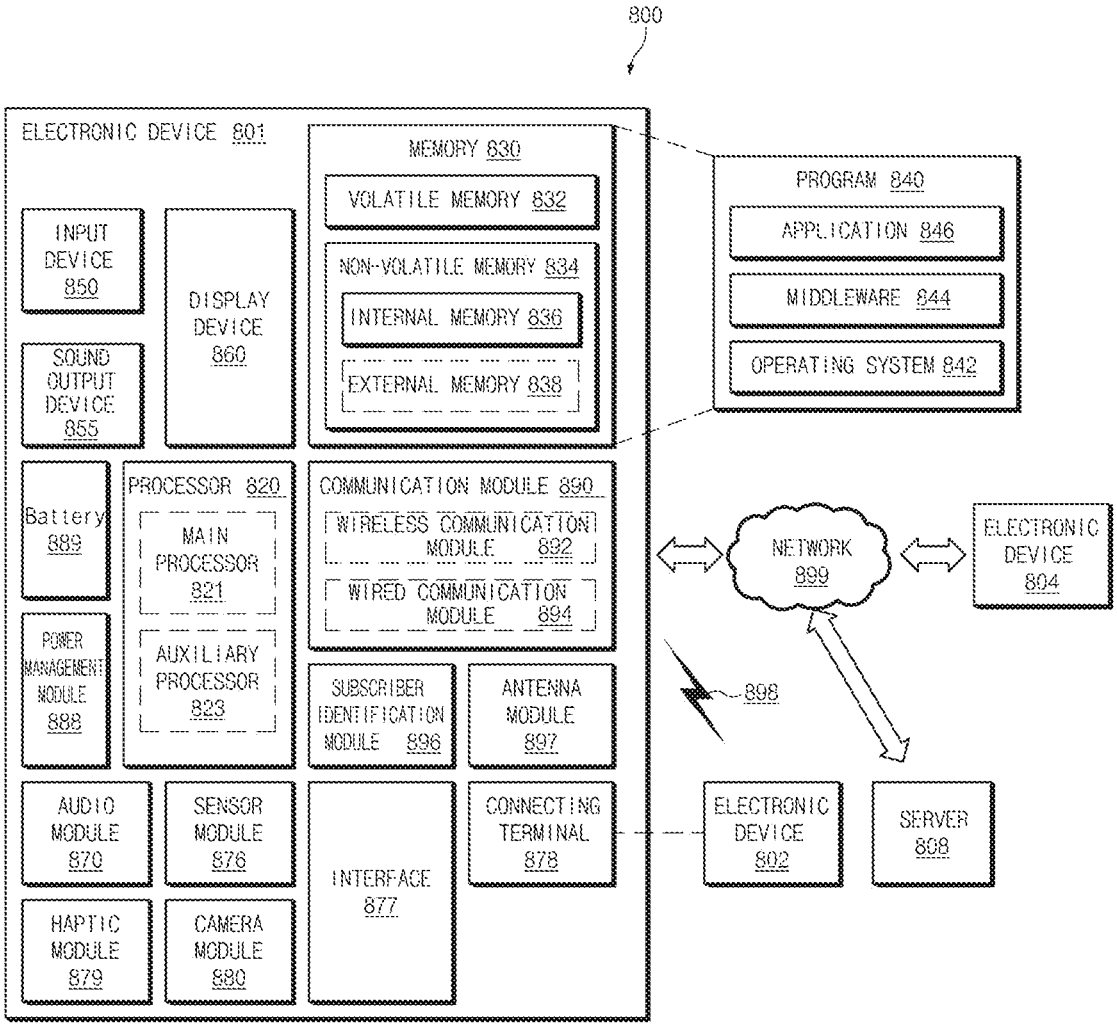
FIG. 8 is a block diagram illustrating an electronic device in a network environment, according to an embodiment of the disclosure.

FIG. 8 is a block diagram of an electronic device in a network environment according to various embodiments.

Referring to FIG. 8, an electronic device 801 may communicate with an electronic device 802 through a first network 898 (e.g., a short-range wireless communication) or may communicate with an electronic device 804 or a server 808 through a second network 899 (e.g., a long-distance wireless communication) in a network environment 800. According to an embodiment, the electronic device 801 may communicate with the electronic device 804 through the server 808. According to an embodiment, the electronic device 801 may include a processor 820, a memory 830, an input device 850, a sound output device 855, a display device 860, an audio module 870, a sensor module 876, an interface 877, a haptic module 879, a camera module 880, a power management module 888, a battery 889, a communication module 890, a subscriber identification module 896, and an antenna module 897. According to some embodiments, at least one (e.g., the display device 860 or the camera module 880) among components of the electronic device 801 may be omitted or other components may be added to the electronic device 801. According to some embodiments, some components may be integrated and implemented as in the case of the sensor module 876 (e.g., a fingerprint sensor, an iris sensor, or an illuminance sensor) embedded in the display device 860 (e.g., a display).

The processor 820 may operate, for example, software (e.g., a program 840) to control at least one of other components (e.g., a hardware or software component) of the electronic device 801 connected to the processor 820 and may process and compute a variety of data. The processor 820 may load a command set or data, which is received from other components (e.g., the sensor module 876 or the communication module 890), into a volatile memory 832, may process the loaded command or data, and may store result data into a nonvolatile memory 834. According to an embodiment, the processor 820 may include a main processor 821 (e.g., a central processing unit or an application processor) and an auxiliary processor 823 (e.g., a graphic processing device, an image signal processor, a sensor hub processor, or a communication processor), which operates independently from the main processor 821, additionally or alternatively uses less power than the main processor 821, or is specified to a designated function. In this case, the auxiliary processor 823 may operate separately from the main processor 821 or embedded.

In this case, the auxiliary processor 823 may control, for example, at least some of functions or states associated with at least one component (e.g., the display device 860, the sensor module 876, or the communication module 890) among the components of the electronic device 801 instead of the main processor 821 while the main processor 821 is in an inactive (e.g., sleep) state or together with the main processor 821 while the main processor 821 is in an active (e.g., an application execution) state. According to an embodiment, the auxiliary processor 823 (e.g., the image signal processor or the communication processor) may be implemented as a part of another component (e.g., the camera module 880 or the communication module 890) that is functionally related to the auxiliary processor 823. The memory 830 may store a variety of data used by at least one component (e.g., the processor 820 or the sensor module 876) of the electronic device 801, for example, software (e.g., the program 840) and input data or output data with respect to commands associated with the software. The memory 830 may include the volatile memory 832 or the nonvolatile memory 834.

The program 840 may be stored in the memory 830 as software and may include, for example, an operating system 842, a middleware 844, or an application 846.

The input device 850 may be a device for receiving a command or data, which is used for a component (e.g., the processor 820) of the electronic device 801, from an outside (e.g., a user) of the electronic device 801 and may include, for example, a microphone, a mouse, or a keyboard.

The sound output device 855 may be a device for outputting a sound signal to the outside of the electronic device 801 and may include, for example, a speaker used for general purposes, such as multimedia play or recordings play, and a receiver used only for receiving calls. According to an embodiment, the receiver and the speaker may be either integrally or separately implemented.

The display device 860 may be a device for visually presenting information to the user of the electronic device 801 and may include, for example, a display, a hologram device, or a projector and a control circuit for controlling a corresponding device. According to an embodiment, the display device 860 may include a touch circuitry or a pressure sensor for measuring an intensity of pressure on the touch.

The audio module 870 may convert a sound and an electrical signal in dual directions. According to an embodiment, the audio module 870 may obtain the sound through the input device 850 or may output the sound through an external electronic device (e.g., the electronic device 802 (e.g., a speaker or a headphone)) wired or wirelessly connected to the sound output device 855 or the electronic device 801.

The sensor module 876 may generate an electrical signal or a data value corresponding to an operating state (e.g., power or temperature) inside or an environmental state outside the electronic device 801. The sensor module 876 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 877 may support a designated protocol wired or wirelessly connected to the external electronic device (e.g., the electronic device 802). According to an embodiment, the interface 877 may include, for example, an HDMI (high-definition multimedia interface), a USB (universal serial bus) interface, an SD card interface, or an audio interface.

A connecting terminal 878 may include a connector that physically connects the electronic device 801 to the external electronic device (e.g., the electronic device 802), for example, an HDMI connector, a USB connector, an SD card connector, or an audio connector (e.g., a headphone connector).

The haptic module 879 may convert an electrical signal to a mechanical stimulation (e.g., vibration or movement) or an electrical stimulation perceived by the user through tactile or kinesthetic sensations. The haptic module 879 may include, for example, a motor, a piezoelectric element, or an electric stimulator.

The camera module 880 may shoot a still image or a video image. According to an embodiment, the camera module 880 may include, for example, at least one lens, an image sensor, an image signal processor, or a flash.

The power management module 888 may be a module for managing power supplied to the electronic device 801 and may serve as at least a part of a power management integrated circuit (PMIC).

The battery 889 may be a device for supplying power to at least one component of the electronic device 801 and may include, for example, a non-rechargeable (primary) battery, a rechargeable (secondary) battery, or a fuel cell.

The communication module 890 may establish a wired or wireless communication channel between the electronic device 801 and the external electronic device (e.g., the electronic device 802, the electronic device 804, or the server 808) and support communication execution through the established communication channel. The communication module 890 may include at least one communication processor operating independently from the processor 820 (e.g., the application processor) and supporting the wired communication or the wireless communication. According to an embodiment, the communication module 890 may include a wireless communication module 892 (e.g., a cellular communication module, a short-range wireless communication module, or a GNSS (global navigation satellite system) communication module) or a wired communication module 894 (e.g., an LAN (local area network) communication module or a power line communication module) and may communicate with the external electronic device using a corresponding communication module among them through the first network 898 (e.g., the short-range communication network such as a Bluetooth, a WiFi direct, or an IrDA (infrared data association)) or the second network 899 (e.g., the long-distance wireless communication network such as a cellular network, an internet, or a computer network (e.g., LAN or WAN)). The above-mentioned various communication modules 890 may be implemented into one chip or into separate chips, respectively.

According to an embodiment, the wireless communication module 892 may identify and authenticate the electronic device 801 using user information stored in the subscriber identification module 896 in the communication network.

The antenna module 897 may include one or more antennas to transmit or receive the signal or power to or from an external source. According to an embodiment, the communication module 890 (e.g., the wireless communication module 892) may transmit or receive the signal to or from the external electronic device through the antenna suitable for the communication method.

Some components among the components may be connected to each other through a communication method (e.g., a bus, a GPIO (general purpose input/output), an SPI (serial peripheral interface), or an MIPI (mobile industry processor interface)) used between peripheral devices to exchange signals (e.g., a command or data) with each other.

According to an embodiment, the command or data may be transmitted or received between the electronic device 801 and the external electronic device 804 through the server 808 connected to the second network 899. Each of the electronic devices 802 and 804 may be the same or different types as or from the electronic device 801. According to an embodiment, all or some of the operations performed by the electronic device 801 may be performed by another electronic device or a plurality of external electronic devices. When the electronic device 801 performs some functions or services automatically or by request, the electronic device 801 may request the external electronic device to perform at least some of the functions related to the functions or services, in addition to or instead of performing the functions or services by itself. The external electronic device receiving the request may carry out the requested function or the additional function and transmit the result to the electronic device 801. The electronic device 801 may provide the requested functions or services based on the received result as is or after additionally processing the received result. To this end, for example, a cloud computing, distributed computing, or client-server computing technology may be used.

The electronic device according to various embodiments disclosed in the present disclosure may be various types of devices. The electronic device may include, for example, at least one of a portable communication device (e.g., a smartphone), a computer device, a portable multimedia device, a mobile medical appliance, a camera, a wearable device, or a home appliance. The electronic device according to an embodiment of the present disclosure should not be limited to the above-mentioned devices.

It should be understood that various embodiments of the present disclosure and terms used in the embodiments do not intend to limit technologies disclosed in the present disclosure to the particular forms disclosed herein; rather, the present disclosure should be construed to cover various modifications, equivalents, and/or alternatives of embodiments of the present disclosure. With regard to description of drawings, similar components may be assigned with similar reference numerals. As used herein, singular forms may include plural forms as well unless the context clearly indicates otherwise. In the present disclosure disclosed herein, the expressions "A or B", "at least one of A or/and B", "A, B, or C" or "one or more of A, B, or/and C", and the like used herein may include any and all combinations of one or more of the associated listed items. The expressions "a first", "a second", "the first", or "the second", used in herein, may refer to various components regardless of the order and/or the importance, but do not limit the corresponding components. The above expressions are used merely for the purpose of distinguishing a component from the other components. It should be understood that when a component (e.g., a first component) is referred to as being (operatively or communicatively) "connected," or "coupled," to another component (e.g., a second component), it may be directly connected or coupled directly to the other component or any other component (e.g., a third component) may be interposed between them.

The term "module" used herein may represent, for example, a unit including one or more combinations of hardware, software and firmware. The term "module" may be interchangeably used with the terms "logic", "logical block", "part" and "circuit". The "module" may be a minimum unit of an integrated part or may be a part thereof. The "module" may be a minimum unit for performing one or more functions or a part thereof. For example, the "module" may include an application-specific integrated circuit (ASIC).

Various embodiments of the present disclosure may be implemented by software (e.g., the program 840) including an instruction stored in a machine-readable storage media (e.g., an internal memory 836 or an external memory 838) readable by a machine (e.g., a computer). The machine may be a device that calls the instruction from the machine-readable storage media and operates depending on the called instruction and may include the electronic device (e.g., the electronic device 801). When the instruction is executed by the processor (e.g., the processor 820), the processor may perform a function corresponding to the instruction directly or using other components under the control of the processor. The instruction may include a code generated or executed by a compiler or an interpreter. The machine-readable storage media may be provided in the form of non-transitory storage media. Here, the term "non-transitory", as used herein, is a limitation of the medium itself (i.e., tangible, not a signal) as opposed to a limitation on data storage persistency.

According to an embodiment, the method according to various embodiments disclosed in the present disclosure may be provided as a part of a computer program product. The computer program product may be traded between a seller and a buyer as a product. The computer program product may be distributed in the form of machine-readable storage medium (e.g., a compact disc read only memory (CD-ROM)) or may be distributed only through an application store (e.g., a Play Store™). In the case of online distribution, at least a portion of the computer program product may be temporarily stored or generated in a storage medium such as a memory of a manufacturer's server, an application store's server, or a relay server.

Each component (e.g., the module or the program) according to various embodiments may include at least one of the above components, and a portion of the above sub-components may be omitted, or additional other sub-components may be further included. Alternatively or additionally, some components (e.g., the module or the program) may be integrated in one component and may perform the same or similar functions performed by each corresponding components prior to the integration. Operations performed by a module, a programming, or other components according to various embodiments of the present disclosure may be executed sequentially, in parallel, repeatedly, or in a heuristic method. Also, at least some operations may be executed in different sequences, omitted, or other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

Figure 9:
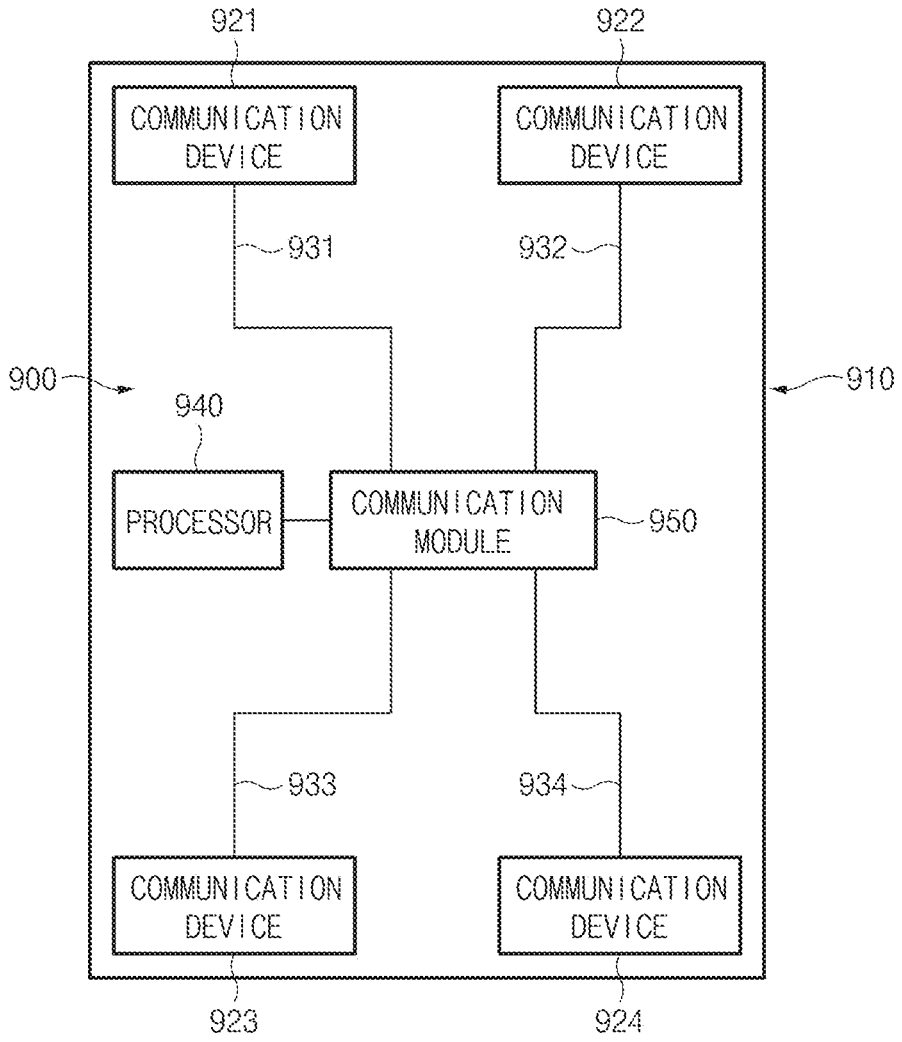
FIG. 9 is a view illustrating an example of an electronic device supporting 5G communication, according to an embodiment of the disclosure.

FIG. 9 is a view illustrating an example of an electronic device supporting 5G communication, according to an embodiment.

Referring to FIG. 9, the electronic device 900 may include a housing 910, a processor 940, a communication module 950 (e.g., the communication module 890 of FIG. 8), a first communication device 921, a second communication device 922, a third communication device 923, a fourth communication device 924, a first conductive line 931, a second conductive line 932, a third conductive line 933, or a fourth conductive line 934.

According to an embodiment, the housing 910 may protect any other components of the electronic device 900. The housing 910 may include, for example, a front plate, a back plate facing away from the front plate, and a side member (or a metal frame) surrounding a space between the front plate and the back plate. The side member may be attached to the back plate or may be integrally formed with the back plate.

According to an embodiment, the electronic device 900 may include at least one communication device. For example, the electronic device 900 may include the first communication device 921, the second communication device 922, the third communication device 923, or the fourth communication device 924.

According to an embodiment, the first communication device 921, the second communication device 922, the third communication device 923, or the fourth communication device 924 may be positioned within the housing 910. According to an embodiment, when viewed from above the front plate of the electronic device 900, the first communication device 921 may be positioned at an upper left end of the electronic device 900, the second communication device 922 may be positioned at an upper right end of the electronic device 900, the third communication device 923 may be positioned at a lower left end of the electronic device 900, and the fourth communication device 924 may be positioned at a lower right end of the electronic device 900.

According to an embodiment, the processor 940 may include one or more of a central processing unit, an application processor, a graphic processing unit (GPU), an image signal processor of a camera, or a baseband processor (or a communication processor (CP)). According to an embodiment, the processor 940 may be implemented with a system on chip (SoC) or a system in package (SiP).

According to an embodiment, the communication module 950 may be electrically connected with at least one communication device by using at least one conductive line. For example, the communication module 950 may be electrically connected with the first communication device 921, the second communication device 922, the third communication device 923, or the fourth communication device 924 by using the first conductive line 931, the second conductive line 932, the third conductive line 933, or the fourth conductive line 934. The communication module 950 may include a baseband processor, a radio frequency integrated circuit (RFIC), or an intermediate frequency integrated circuit (IFIC). The communication module 950 may include a baseband processor which is independent of the processor 940 (e.g., an application processor (AP)). The first conductive line 931, the second conductive line 932, the third conductive line 933, or the fourth conductive line 934 may include, for example, a coaxial cable or a flexible printed circuit board (FPCB).

According to an embodiment, the communication module 950 may include a first baseband processor (BP) (not illustrated) or a second baseband processor (not illustrated). The electronic device 900 may further include one or more interfaces for supporting inter-chip communication between the first BP (or the second BP) and the processor 940. The processor 940 and the first BP or the second BP may transmit/receive data by using the inter-chip interface (e.g., an inter processor communication channel).

According to an embodiment, the first BP or the second BP may provide an interface for performing communication with any other entities. The first BP may support, for example, wireless communication with regard to a first network (not illustrated). The second BP may support, for example, wireless communication with regard to a second network (not illustrated).

According to an embodiment, the first BP or the second BP may form one module with the processor 940. For example, the first BP or the second BP may be integrally formed with the processor 940. For another example, the first BP or the second BP may be positioned within one chip or may be implemented in the form of an independent chip. According to an embodiment, the processor 940 and at least one baseband processor (e.g., the first BP) may be integrally formed within one chip (a SoC), and another baseband processor (e.g., the second BP) may be implemented in the form of an independent chip.

According to an embodiment, the first network (not illustrated) or the second network (not illustrated) may correspond to the network 899 of FIG. 8. According to an embodiment, the first network (not illustrated) and the second network (not illustrated) may include a 4G network and a 5G network, respectively. The 4G network may support, for example, a long term evolution (LTE) protocol defined in the 3GPP. The 5G network may support, for example, a new radio (NR) protocol defined in the 3GPP.

Figure 10:
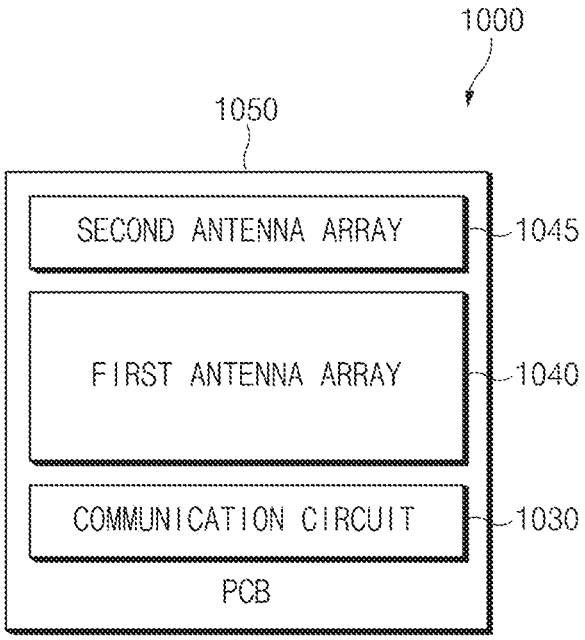
FIG. 10 is a block diagram illustrating a communication device, according to an embodiment of the disclosure.

FIG. 10 is a block diagram illustrating a communication device, according to an embodiment.

Referring to FIG. 10, the communication device 1000 may include a communication circuit 1030 (e.g., an RFIC), a PCB 1050, and at least one antenna array (e.g., a first antenna array 1040 or a second antenna array 1045).

According to an embodiment, a communication circuit or at least one antenna array may be positioned on or in the PCB 1050. For example, the first antenna array 1040 or the second antenna array 1045 may be positioned on a first surface of the PCB 1050, and the RFIC 1030 may be positioned on a second surface of the PCB 1050. The PCB 1050 may include a coaxial cable connector or a board to board (B-to-B) connector for electrical connection with any other PCB (e.g., a PCB on which the communication module 950 of FIG. 9 is positioned) by using a transmission line (e.g., the first conductive line 931 of FIG. 9 or a coaxial cable). The PCB 1050 may be connected with the PCB, on which the communication module 950 is positioned, for example, by using a coaxial cable, and the coaxial cable may be used to transmit a receive/transmit IF or RF signal. For another example, a power or any other control signal may be provided through the B-to-B connector.

According to an embodiment, the first antenna array 1040 or the second antenna array 1045 may include a plurality of antenna elements. The plurality of antenna elements may include a patch antenna or a dipole antenna. For example, an antenna element included in the first antenna array 1040 may be a patch antenna for forming a beam toward a back plate of the electronic device 900. For another example, an antenna element included in the second antenna array 1045 may be a dipole antenna for forming a beam toward a side member of the electronic device 900.

According to an embodiment, the communication circuit 1030 may support a frequency band ranging from 24 GHz to 30 GHz or ranging from 37 GHz to 40 GHz. According to an embodiment, the communication circuit 1030 may up-convert or down-convert a frequency. For example, a communication circuit included in the first communication device 921 may up-convert an IF signal received from the communication module 950 through the first conductive line 931. For another example, the communication circuit may down-convert a millimeter wave signal received through the first antenna array 1040 or the second antenna array 1045 included in the first communication device 921 and may transmit the down-converted signal to the communication module 950.

Figure 11:
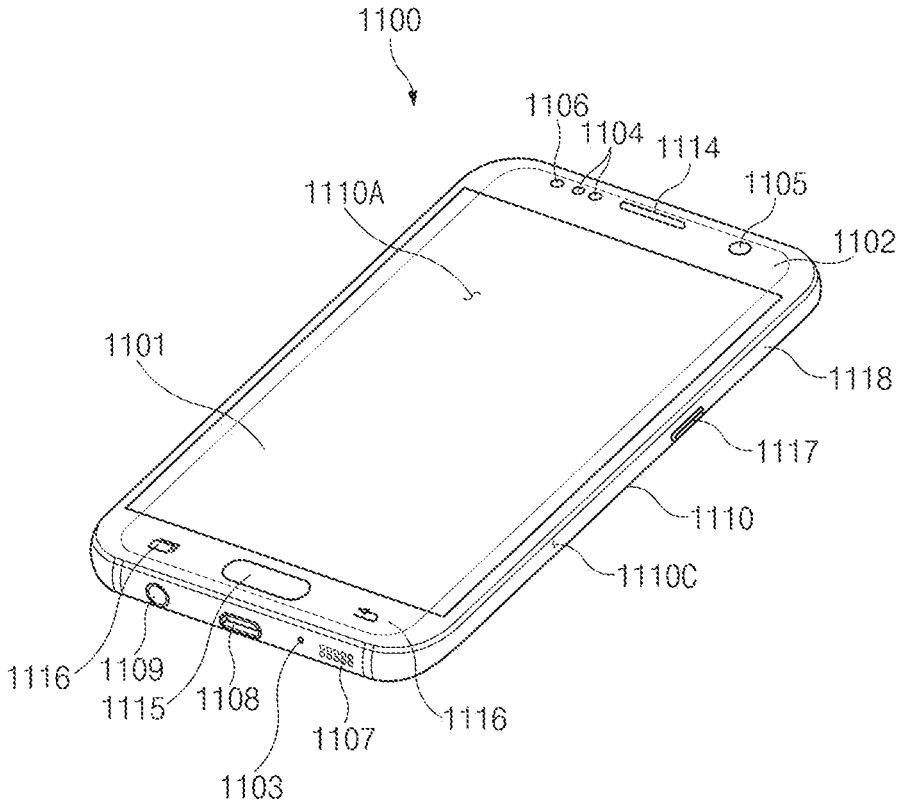
FIG. 11 is a front perspective view of an electronic device according to an embodiment of the disclosure.

FIG. 11 is a front perspective view of an electronic device according to an embodiment.

Figure 12:
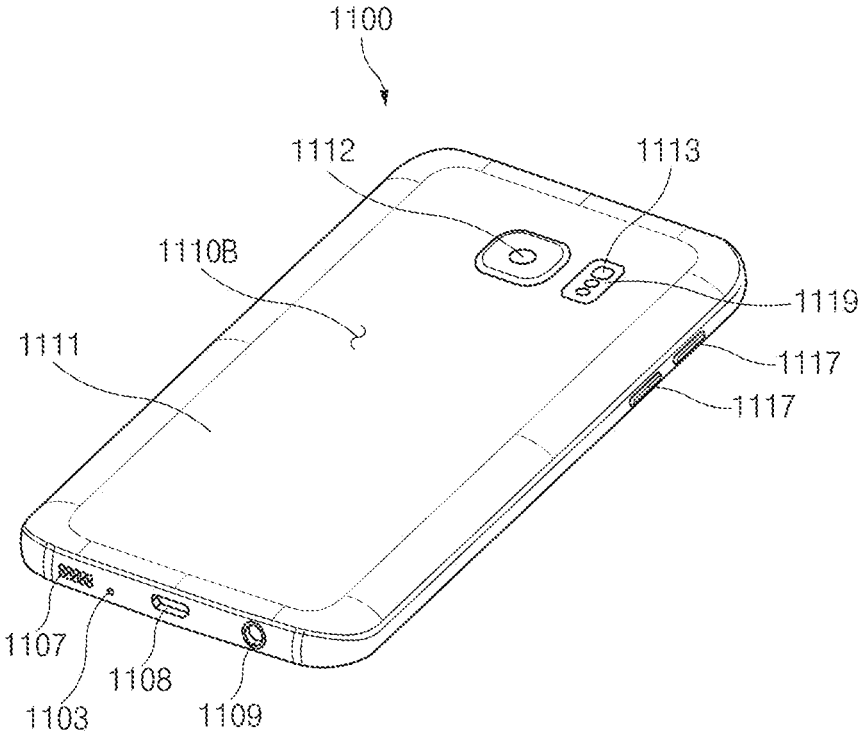
FIG. 12 is a rear perspective view of an electronic device of FIG. 11 according to an embodiment of the disclosure.

FIG. 12 is a rear perspective view of an electronic device of FIG. 11.

Figure 13:
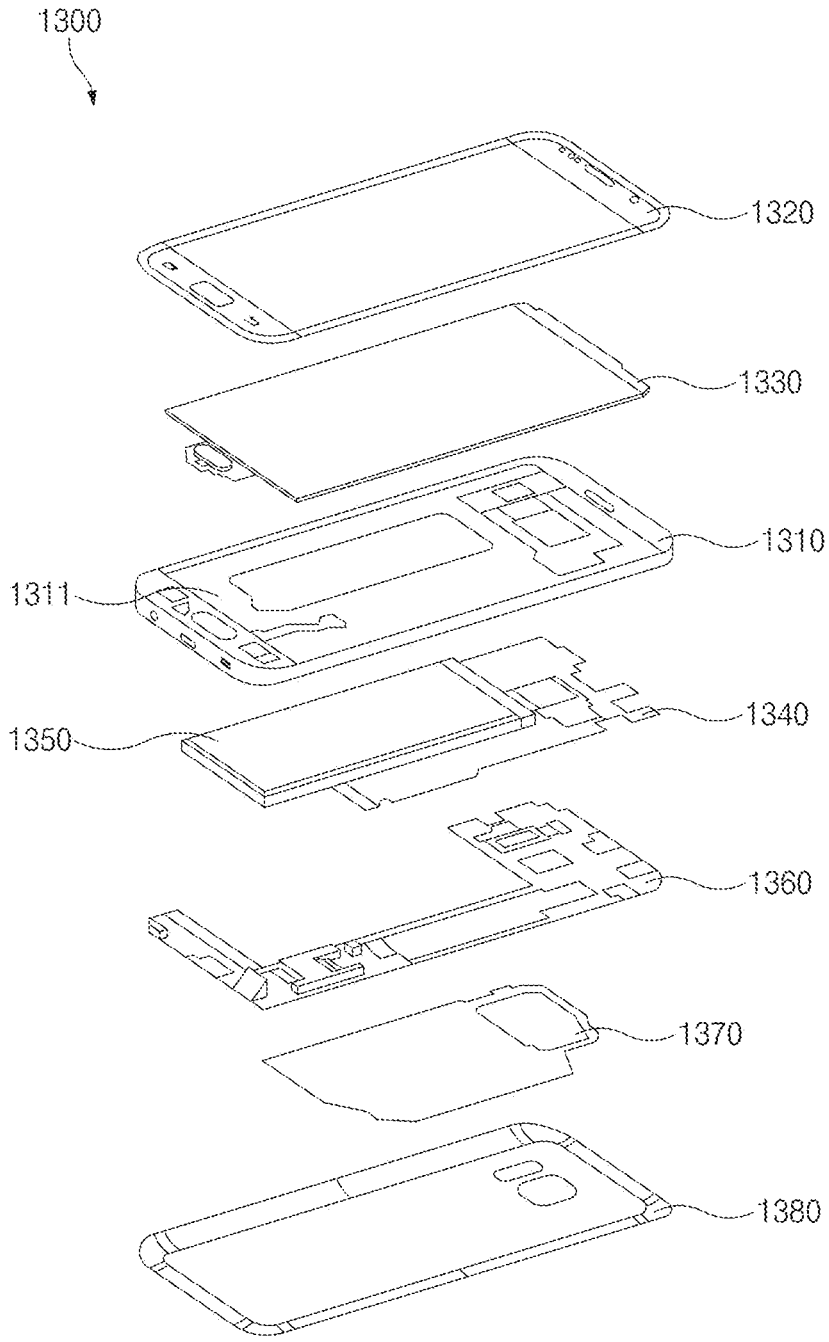
FIG. 13 is an exploded perspective view of an electronic device of FIG. 11 according to an embodiment of the disclosure.

FIG. 13 is an exploded perspective view of an electronic device of FIG. 11.

Referring to FIGS. 11 and 12, an electronic device 1100 according to an embodiment may include a housing 1110 including a first surface (or a front surface) 1110A, a second surface (or a rear surface) 1110B, and a side surface 1110C surrounding a space between the first surface 1110A and the second surface 1110B. In another embodiment (not illustrated), a housing may refer to a structure which forms a part of the first surface 1110A, the second surface 1110B, and side surfaces 1110C of FIG. 11. According to an embodiment, the first surface 1110A may be formed by a first plate (or a front plate) 1102 (e.g., a glass plate including various coating layers, or a polymer plate), at least a portion of which is substantially transparent. The second surface 1110B may be formed by a rear plate 1111 which is substantially opaque. For example, the rear plate 1111 may be formed by coated or colored glass, ceramic, polymer, metal (e.g., aluminum, stainless steel (STS), or magnesium), or a combination of at least two of the materials. The side surface 1110C may be coupled with the front plate 1102 and the rear plate 1111, and may be formed by a side bezel structure (or a "side member") 1118 including metal and/or polymer. In any embodiment, the rear plate 1111 and the side bezel structure 1118 may be integrally formed and may include the same material (e.g., a metal material such as aluminum).

According to an embodiment, the electronic device 1100 may include at least one or more of a display 1101, an audio module (1103, 1107, 1114), a sensor module 1104, a camera module 1105, a key input device (1115, 1116, 1117), an indicator 1106, and a connector hole (1108, 1109). In any embodiment, the electronic device 1100 may not include at least one (e.g., the key input device (1115, 1116, 1117) or the indicator 1106) of the components or may further include any other component.

The display 1101 may be exposed through a considerable portion of the front plate 1102, for example. The display

1101 may be coupled with a touch sensing circuit, a pressure sensor which may measure the intensity (or pressure) of a touch, and/or a digitizer detecting a magnetic stylus pen or may be positioned adjacent thereto.

The audio module (1103, 1107, 1114) may include a microphone hole 1103 and a speaker hole (1107, 1114). A microphone for obtaining external sound may be positioned within the microphone hole 1103. In any embodiment, a plurality of microphones may be positioned to make it possible to detect a direction of sound. The speaker hole (1107, 1114) may include an external speaker hole 1107 and a receiver hole 1114 for call. In any embodiment, the speaker hole (1107, 1114) and the microphone hole 1103 may be implemented with one hole, or a speaker (e.g., a piezo speaker) may be included without the speaker hole (1107, 1114).

The sensor module 1104 may generate an electrical signal or a data value corresponding to an internal operation state of the electronic device 1100 or corresponding to an external environment state. The sensor module 1104 may include, for example, a first sensor module 1104 (e.g., a proximity sensor) and/or a second sensor module (not illustrated) (e.g., a fingerprint sensor) positioned on the first surface 1110A of the housing 1110, and/or a third sensor module (e.g., a hear rate monitor (HRM) sensor) positioned on the second surface 1110B of the housing 1110. The fingerprint sensor may be positioned on the second surface 1110B as well as the first surface 1110A (e.g., a home key button 1115) of the housing 1110. The electronic device 1100 may further include a sensor module not illustrated, for example, at least one of a gesture sensor, a grip sensor, a barometric pressure sensor, a magnetic sensor, an acceleration sensor, a grip sensor, a color sensor, an infrared (IR) sensor, a biometric sensor, a temperature sensor, a humidity sensor, or an illumination sensor.

The camera module 1105 may include a first camera device 1105 positioned on the first surface 1110A of the electronic device 1100, and a second camera module 1112, a sensor module 1119, and/or a flash 1113 positioned on the second surface 1110B. The camera module 1105 may include one or more lenses, an image sensor, and/or an image signal processor. The flash may include, for example, a light emitting diode or a xenon lamp. In any embodiment, two or more lenses (wide-angle and telephoto lenses) and image sensors may be positioned on one surface of the electronic device 1100.

The key input device (1115, 1116, 1117) may include the home key button 1115 positioned on the first surface 1110A of the housing 1110, a touch pad 1116 positioned in the vicinity of the home key button 1115, and/or a side key button 1117 positioned on the side surface 1110C of the housing 1110. In another embodiment, the electronic device 1100 may not include all or a part of the key input device (1115, 1116, 1117), and the key input device not included may be implemented on the display 1101 in the form of a soft key.

The indicator 1106 may be positioned, for example, on the first surface 1110A of the housing 1110. The indicator 1106 may provide state information of the electronic device 1100, for example, in the form of light, and may include an LED.

The connector hole (1108, 1109) may include a first connector hole 1108 which may accommodate a connector (e.g., a USB connector) for transmitting/receiving a power and/or data to/from an external electronic device, and/or a second connector hole (or an earphone jack) 1109 which may accommodate a connector for transmitting/receiving an audio signal to/from the external electronic device.

Referring to FIG. 13, an electronic device 1300 may include a side bezel structure 1310, a first support member 1311 (e.g., a bracket), a front plate 1320, a display 1330, a printed circuit board 1340, a battery 1350, a second support member 1360 (e.g., a rear case), an antenna 1370, and a rear plate 1380. In any embodiment, the electronic device 1300 may not include at least one (e.g., the first support member 1311 or the second support member 1360) of the components or may further include any other component. At least one of the components of the electronic device 1300 may be identical or similar to at least one of the components of the electronic device 1100 of FIG. 11 or 12, and thus, additional description will be omitted to avoid redundancy.

The first support member 1311 may be positioned within the electronic device 1300 so as to be connected with the side bezel structure 1310, or may be integrally formed with the side bezel structure 1310. The first support member 1311 may be formed of, for example, a metal material and/or a nonmetal material (e.g., polymer). The display 1330 may be coupled with one surface of the first support member 1311, and the printed circuit board 1340 may be coupled with an opposite surface of the first support member 311. A processor, a memory, and/or an interface may be mounted on the printed circuit board 1340. For example, the processor may include one or more of a central processing unit, an application processor, a graphic processing device, an image signal processor, a sensor hub processor, or a communication processor.

The memory may include, for example, a volatile memory or a nonvolatile memory.

The interface may include, for example, a high definition multimedia interface (HDMI), a universal serial bus (USB) interface, a secure digital (SD) card interface, and/or an audio interface. The interface may electrically or physically connect, for example, the electronic device 1300 with an external electronic device and may include a USB connector, an SD card/MMC connector, or an audio connector.

The battery 1350 which is a device for supplying a power to at least one component of the electronic device 1300 may include, for example, a primary cell incapable of being recharged, a secondary cell rechargeable, or a fuel cell. At least a part of the battery 1350 may be positioned on substantially the same plane as the printed circuit board 1340, for example. The battery 1350 may be integrally positioned within the electronic device 1100, or may be positioned to be removable from the electronic device 1100.

The antenna 370 may be interposed between the rear plate 1380 and the battery 1350. The antenna 1370 may include, for example, a near field communication (NFC) antenna, an antenna for wireless charging, and/or a magnetic secure transmission (MST) antenna. For example, the antenna 1370 may perform short range communication with an external device or may wirelessly transmit/receive a power needed for charging. In another embodiment, an antenna structure may be formed by a part of the side bezel structure 1310 and/or the first support member 1311, or by a combination thereof.

According to embodiments of the disclosure, an electronic device may reduce influence of a housing formed of a dielectric substance upon radiating a millimeter wave signal. In other words, the electronic device may allow a radiation pattern of the millimeter wave signal to have directivity in a target direction and may reduce distortion of the radiation pattern due to the housing. As a result, communication performance of the electronic device may be improved.

An electronic device according to an embodiment of the disclosure may include a housing that includes a front surface, a rear surface facing away from the front surface, and a side surface surrounding a space between the front surface and the rear surface, wherein the front surface is formed of a dielectric substance having first permittivity and the rear surface is formed of a dielectric substance having second permittivity, an antenna array that is positioned adjacent to the side surface, radiates a millimeter wave signal, and includes at least one antenna element, a communication circuit that is electrically connected with the antenna array and communicates by using the millimeter wave signal, and an electrical element that is positioned to be spaced from the antenna array by a specified distance such that a radiation pattern of the millimeter wave signal radiated from the antenna array has a directivity toward the side surface.

According to an embodiment, of the disclosure the electronic device may further include a printed circuit board, the antenna array may include a plurality of antenna elements extended and mounted from one end of the printed circuit board, the printed circuit board may include at least one ground member, and the ground member may shield a component, which is radiated toward at least a portion of the front surface or the rear surface, of the millimeter wave signal radiated from the antenna array.

In an embodiment of the disclosure, the plurality of antenna elements may be spaced and arranged at a specified interval.

In an embodiment of the disclosure, the antenna element may be extended and mounted toward the front surface of the housing from the one end of the printed circuit board.

In an embodiment of the disclosure, the antenna element may be extended and mounted toward the rear surface of the housing from the one end of the printed circuit board.

In an embodiment of the disclosure, the antenna element may be extended and mounted toward the side surface of the housing from the one end of the printed circuit board.

According to an embodiment of the disclosure, the electrical element may include a wave absorber, and the wave absorber may absorb a portion of a component, which is radiated toward the front surface or the rear surface, of the millimeter wave signal radiated from the antenna array.

According to an embodiment of the disclosure, the electrical element may include a reflection member, and the reflection member may reflect a portion of a component, which is radiated toward the front surface or the rear surface, of the millimeter wave signal radiated from the antenna array.

According to an embodiment of the disclosure, the electrical element may include a ground member, and the ground member may shield a portion of a component, which is radiated toward the front surface or the rear surface, of the millimeter wave signal radiated from the antenna array.

According to an embodiment of the disclosure, the antenna array may include a dipole antenna array.

According to an embodiment of the disclosure, the antenna array may include a monopole antenna array.

According to an embodiment of the disclosure, the electronic device may further include a patch antenna array electrically connected with the communication circuit, and the patch antenna array may radiate the millimeter wave signal toward the front surface or the rear surface.

In an embodiment of the disclosure, the antenna array may radiate a millimeter wave signal including a first frequency band, and the patch antenna array may radiate a millimeter wave signal including a second frequency band.

In an embodiment of the disclosure, the first frequency band may be identical to the second frequency band.

According to an embodiment of the disclosure, the millimeter wave signal may be a signal having a frequency between 20 GHz and 100 GHz.

According to an embodiment of the disclosure, the first permittivity and the second permittivity may have the same magnitude.

According to an embodiment of the disclosure, the electrical element may correspond to a first electrical element, the electronic device may further include a second electrical element that is interposed between the antenna array and the rear surface, and the second electrical element may allow a radiation pattern of the millimeter wave signal radiated from the antenna array to have a directivity in a direction forming a specified angle with the rear surface.

In an embodiment of the disclosure, the second electrical element may include a ground, a size of which is smaller than a specified size.

In an embodiment of the disclosure, the second electrical element may be positioned to be adjacent within a specified distance from the antenna array.

According to an embodiment, of the disclosure a cross section of the side surface may be in the shape of at least one of a rectangle, a semicircle, and a triangle.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing including:

a front surface comprising a dielectric substance having a first permittivity, a rear surface comprising a dielectric substance having a second permittivity, the rear surface facing away from the front surface, and a side surface surrounding a space between the front surface and the rear surface;

a printed circuit board including at least one ground member;

an antenna array positioned adjacent to the side surface and configured to radiate a millimeter wave signal, the antenna array including at least one antenna element;

a communication circuit electrically connected with the antenna array and configured to communicate by using the millimeter wave signal; and an electrical element positioned to be spaced from the antenna array by a specified distance such that a radiation pattern of the millimeter wave signal radiated from the antenna array has a directivity toward the side surface, wherein the at least one ground member shields a component of the millimeter wave signal radiated from the antenna array toward at least a first portion of the front surface or the rear surface, and wherein the electrical element shields a component of the millimeter wave signal radiated from the antenna array toward at least a second portion of the front surface or the rear surface.

2. The electronic device of claim 1, wherein the antenna array includes a plurality of antenna elements extended and mounted from one end of the printed circuit board.

3. The electronic device of claim 2, wherein the plurality of antenna elements is spaced and arranged at a specified interval.

4. The electronic device of claim 2, wherein the at least one antenna element is extended and mounted toward the front surface of the housing from the one end of the printed circuit board.

5. The electronic device of claim 2, wherein the at least one antenna element is extended and mounted toward the rear surface of the housing from the one end of the printed circuit board.

6. The electronic device of claim 2, wherein the at least one antenna element is extended and mounted toward the side surface of the housing from the one end of the printed circuit board.

7. The electronic device of claim 1, wherein the electrical element includes a wave absorber, and wherein the wave absorber absorbs a portion of a component of the millimeter wave signal radiated from the antenna array, the component being radiated toward the front surface or the rear surface.

8. The electronic device of claim 1, wherein the electrical element includes a reflection member, and wherein the reflection member reflects a portion of a component of the millimeter wave signal radiated from the antenna array, the component being radiated toward the front surface or the rear surface.

9. The electronic device of claim 1, wherein the electrical element includes a ground member, and wherein the ground member shields a portion of a component of the millimeter wave signal radiated from the antenna array, the component being radiated toward the front surface or the rear surface.

10. The electronic device of claim 1, wherein the antenna array includes a dipole antenna array.

11. The electronic device of claim 1, wherein the antenna array includes a monopole antenna array.

12. The electronic device of claim 1, further comprising:

a patch antenna array electrically connected with the communication circuit, wherein the patch antenna array radiates the millimeter wave signal toward the front surface or the rear surface.

13. The electronic device of claim 12, wherein the antenna array radiates the millimeter wave signal including a first frequency band, and wherein the patch antenna array radiates the millimeter wave signal including a second frequency band.

14. The electronic device of claim 13, wherein the first frequency band is identical to the second frequency band.

15. The electronic device of claim 1, wherein the millimeter wave signal includes a frequency between 20 GHz and 100 GHz.

16. The electronic device of claim 1, wherein a magnitude of the first permittivity and a magnitude of the second permittivity are identical.

17. The electronic device of claim 1, wherein the electrical element comprises:

a first electrical element, and a second electrical element interposed between the antenna array and the rear surface, and wherein the second electrical element allows a radiation pattern of the millimeter wave signal radiated from the antenna array to have a directivity in a direction forming a specified angle with the rear surface.

18. The electronic device of claim 17, wherein the second electrical element includes a ground member, and wherein a size of the ground member of the second electrical element is smaller than a specified size.

19. The electronic device of claim 17, wherein the second electrical element is positioned to be adjacent, within a specified distance, from the antenna array.

20. The electronic device of claim 1, wherein a cross section of the side surface is in the form of at least one of a rectangle, a semicircle, or a triangle.

* * * * *